US005582964A

United States Patent [19]

Hashimoto et al.

[11] Patent Number: 5,582,964

[45] Date of Patent: Dec. 10, 1996

[54] PHOTOGRAPHIC MATERIAL HAVING A SYNDIOTACTIC STYRENIC POLYMER CONTAINING SUPPORT

[75] Inventors: Kiyokazu Hashimoto; Akira Hatakeyama, both of Kanagawa, Japan

[73] Assignee: Fuji Photo Film Co., Ltd., Kanagawa, Japan

[21] Appl. No.: 422,267

[22] Filed: Apr. 14, 1995

[30] Foreign Application Priority Data

Apr. 14, 1994 [JP] Japan ..... 6-075919

[51] Int. Cl.[6] ..... G03C 1/795

[52] U.S. Cl. ..... 430/536; 430/531

[58] Field of Search ..... 430/523, 531, 430/539, 536

[56] References Cited

U.S. PATENT DOCUMENTS 5,188,930 2/1993 Funaki et al. ..... 430/531

*Primary Examiner*—Lee G. Wright

*Attorney, Agent, or Firm*—Birch, Stewart, Kolasch & Birch, LLP

[57] ABSTRACT

A silver halide photographic material favorably employable in combination with a presensitized plate comprisies a plastic support comprising a syndiotactic styrenic polymer and at least one silver halide emulsion layer, wherein the support shows a transmittance at 350 nm of not less than 70%, said transmittance being measured on the support of 100 μm thick.

11 Claims, 2 Drawing Sheets

PHOTOGRAPHIC MATERIAL HAVING A SYNDIOTACTIC STYRENIC POLYMER CONTAINING SUPPORT

FIELD OF THE INVENTION

The present invention relates to a silver halide photographic material which comprises a plastic support containing styrenic polymer and at least one silver halide emulsion layer provided thereon. The invention further relates to a process for the preparation of the photographic material and an image forming process using the material.

BACKGROUND OF THE INVENTION

A silver halide photographic material usually has a problem regarding dimensional stability. The dimension changes according to the change of temperature or humidity, particularly to the change of humidity. The dimensional change is a problem, when the photographic material is used for the preparation of a printing plate, which requires reproducing a dot image for a multicolor print or a minute line art.

The dimensional change is due to the changes of the protective colloidal layers (including silver halide emulsion layers) and the support. Accordingly, the colloidal layers and the support should be improved to obtain a high dimensional stability.

However, the improvement of the conventional polyethylene terephthalate support in dimensional stability has almost reached its technical limit. Therefore, a new plastic support should be developed to obtain high dimensional stability.

Japanese Patent Provisional Publication No. 3(1991)-131843 (corresponding to U.S. Pat. No. 5,188,930 and European Patent Application No. 0423712A1) discloses a photographic film containing a syndiotactic styrenic polymer, which can be used as a support in a photographic material. The plastic support of the syndiotactic styrenic polymer has excellent dimensional stability to humidity variations. However, the present inventors have noted some problems when the plastic support of the syndiotactic styrene polymer is used as the support in a photographic material, particularly a material for the preparation of a printing plate.

SUMMARY OF THE INVENTION

The serious problem of the plastic support disclosed in Japanese Patent Provisional Publication No. 3(1991)-131843 is a low transmittance of ultraviolet light.

A process for forming an image on a presensitized plate using a photographic material comprises the steps of laminating a developed photographic material on a presensitized plate, and exposing the presensitized plate to ultraviolet rays through the photographic material to form a print image on the plate. Accordingly, the ultraviolet ray should be transmitted through the support of the photographic material to reach the light sensitive layer of the presensitized plate. The light source of the ultraviolet ray is typically a mercury lamp, which emits rays of about 350 nm. Therefore, a photographic support requires a high transmittance of ultraviolet within the range of about 350 nm.

It has been known that crystals of a syndiotactic styrenic polymer quickly grow while forming a plastic film. Spherulites (spherical crystals) in the film scatter light, particularly ultraviolet, which has a short wavelength. The problem of light scattering within the visible region is reported as haze in Japanese Patent Provisional Publication No. 3(1991)-131843. According to the invention of the Publication, the conditions for the preparation of the film can be so adjusted that haze is not more than 3%. However, the haze is caused by scattered visible light. Ultraviolet is more easily scattered. The transmittance of ultraviolet cannot be increased only by decrease of the haze. The haze within the visible region can be decreased by inhibiting the growth of spherulites having a diameter of more than 5 μm. On the other hand, the growth of smaller spherulites (diameter: 5 μm or less) must be inhibited to obtain a high transmittance of ultraviolet. Accordingly, the high transmittance of ultraviolet requires not only decreasing the number of the spherulites but also controlling the diameters of them. The growth of the spherulites cannot be so controlled according to the disclosures of Japanese Patent Provisional Publication No. 3(1991)-131843.

An object of the present invention is to provide a silver halide photographic material which is improved in dimensional stability and transmittance of ultraviolet light.

Another object of the invention is to provide a process for the preparation of the silver halide photographic material.

A further object of the invention is to provide an image forming process using the photographic material.

The present invention provides a silver halide photographic material which has a plastic support comprising a syndiotactic styrenic polymer and at least one silver halide emulsion layer provided thereon, wherein the support shows a transmittance at 350 nm of not less than 70%, said transmittance being measured on the support of 100 μm thick.

The photographic material can be prepared by a process comprising the steps of:

extruding melted plastic comprising the syndiotactic styrenic polymer on a casting drum to form a plastic sheet;

cooling the sheet on the drum at a temperature of from 25° C. to a temperature higher than a glass transition temperature of the syndiotactic styrenic polymer by 20° C.;

conveying the sheet on a roll having a diameter of 50 to 1,000 mm at from a temperature lower than the glass transition temperature by 70° C. to a temperature higher than the glass transition temperature by 20° C.;

stretching the sheet to prepare the plastic support; and forming a silver halide emulsion layer on the plastic support.

The photographic material can be advantageously used in an image forming process comprising the steps of:

imagewise exposing to light a silver halide photographic material of claim 1, developing the photographic material to form a photographic image;

laminating the photographic material on a presensitized plate; and exposing to ultraviolet rays the presensitized plate through the photographic material to form a print image on the plate.

DETAILED DESCRIPTION OF THE INVENTION

Figure 1:
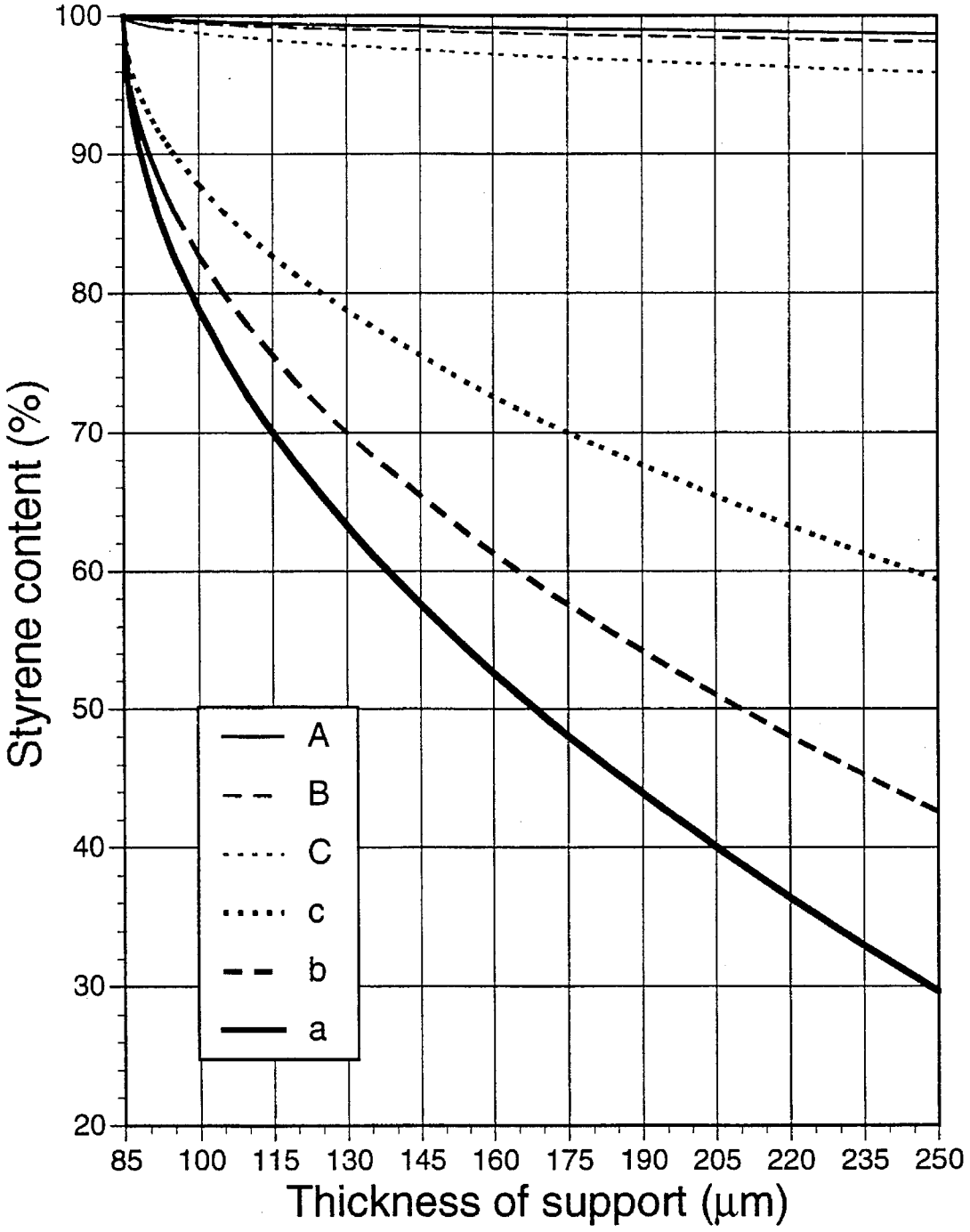
FIG. 1 is a graph showing a preferred range of styrene content in a copolymer or a polymer mixture.

The plastic support of the present invention consists of plastic comprising a syndiotactic styrenic polymer, and the plastic has such a transmittance that at least 70% of ultraviolet at 350 nm is transmitted through the plastic of 100 μm thickness. The transmittance of ultraviolet is preferably in the range of 76 to 100%, and more preferably in the range of 80 to 100%.

In the present specification, the styrenic polymer means polystyrene, polymers of styrene derivatives and copolymers thereof.

Examples of the styrene derivatives include alkylstyrenes, arylstyrenes, alkenylstyrenes, halogenated styrenes, halogenated alkylstyrenes and alkoxystyrenes. Examples of the alkylstyrenes include methylstyrene, ethylstyrene, propylstyrene and butylstyrene. An example of the arylstyrene is phenylstyrene. An example of the alkenylstyrene is vinylstyrene. Examples of the halogenated styrenes include chlorostyrene, bromostyrene and fluorostyrene. Examples of the alkoxystyrenes include methoxystyrene and ethoxystyrene. The styrene derivatives further include compounds formed by condensing the benzene ring of styrene with another aromatic ring. Examples of such compounds include vinylnaphthalene and acenaphthylene. The styrene derivatives furthermore include hydrogenated styrenes (e.g., vinylcyclohexane). Preferred monomers for the styrenic polymers include styrene, alkylstyrenes (e.g., p-methylstyrene, m-methylstyrene, p-tert-butylstyrene), hydrogenated styrenes and halogenated styrenes (e.g., p-chlorostyrene, m-chlorostyrene, p-fluorostyrene). Styrene and alkylstyrenes (particularly p-methylstyrene) are more preferred.

The styrenic polymer consists of a main chain (comprising carbon to carbon bond) and a side chain (phenyl or its derivative). The carbon atom of the main chain to which the side chain is attached is asymmetric carbon. The syndiotactic styrenic polymer has a regular configuration that the asymmetric carbon atoms are arranged almost alternatively in opposite directions.

The streogerularity (tacticity) can be most precisely determined by a nuclear magnetic resonance method using carbon isotope ($^{13}$C-NMR). The tacticity measured by the $^{13}$C-NMR method is indicated by the number of continuous structural (repeating) units. For example, a diad means two continuous structural units, a triad means three continuous three units, and a pentad means five continuous units.

The syndiotactic styrenic polymer of the present invention generally has such a tacticity that the content of a racemic diad is 75 to 100% (preferably 85 to 100%). The racemic diad means that two asymmetric carbon atoms are arranged alternatively in opposite directions in two continuous structural units. The syndiotactic styrenic polymer preferably has such a tacticity that the content of a racemic pentad is 30 to 100% (preferably 50 to 100%).

The syndiotactic styrenic polymer is preferably in the form of a copolymer. The combinations of two monomers for the copolymer include the following (1), (2), (3) and (4). The combinations of three or more monomers for the copolymer can be obtained by further combining the following (1) to (4).

(1) Styrene and styrene derivative (2) Styrene and another vinyl monomer (3) Styrene derivative and another styrene derivative (4) Styrene derivative and another vinyl monomer The combinations (1) and (2) are preferred. The combination (1) is most preferred.

The styrene moiety and the styrene derivative moieties in the copolymers have the syndiotactic structure. However, the whole structure of the copolymer preferably is syndiotactic.

Examples of styrene and styrene derivatives are described above.

Examples of other vinyl monomers include olefin monomers (e.g., ethylene, propylene, butene, hexene, octene), diene monomers (e.g., butadiene, isoprene), cyclic olefin monomers, cyclic diene monomers, acrylic esters, methacrylic esters (e.g., methyl methacrylate), maleic anhydride and acrylonitrile.

The structure of the copolymer may be block, random or alternative.

In the case of the combination (1), the ratio of styrene unit in the copolymer is preferably in the range defined in the following formula (Ia):

$$100-\sqrt{30\times(T-85)} \leqq S \leqq 100-\sqrt{\frac{T-85}{100}} \quad \text{(Ia)}$$

In the formula (Ia), S means the ratio (wt. %) of the styrene unit in the copolymer, and T means the thickness (μm) of the support.

The ratio of styrene unit in the copolymer is more preferably in the range defined in the following formula (Ib), and most preferably in the range defined in the formula (Ic):

$$100-\sqrt{20\times(T-85)} \leqq S \leqq 100-\sqrt{\frac{T-85}{50}} \quad \text{(Ib)}$$

$$100-\sqrt{10\times(T-85)} \leqq S \leqq 100-\sqrt{\frac{T-85}{10}} \quad \text{(Ic)}$$

In the formulas (Ib) and (Ic), S and T have the same meanings as defined in the formula (Ia).

Examples of the preferred copolymers are shown below. In the following examples, the term "syn-" means syndiotactic (structure).

| Copolymer | Units | Copolymerizing ratio (wt. %) |
|---|---|---|
| (CP-1) | Styrene/p-methylstyrene syn-copolymer | (98/2) |
| (CP-2) | Styrene/p-methylstyrene syn-copolymer | (97/3) |
| (CP-3) | Styrene/p-methylstyrene syn-copolymer | (95/5) |
| (CP-4) | Styrene/p-methylstyrene syn-copolymer | (93/7) |
| (CP-5) | Styrene/p-methylstyrene syn-copolymer | (85/15) |
| (CP-6) | Styrene/p-methylstyrene syn-copolymer | (80/20) |
| (CP-7) | Styrene/p-chlorostyrene syn-copolymer | (95/5) |
| (CP-8) | Styrene/p-chlorostyrene syn-copolymer | (93/7) |
| (CP-9) | Styrene/p-chlorostyrene syn-copolymer | (85/15) |
| (CP-10) | Styrene/p-chlorostyrene syn-copolymer | (80/20) |
| (CP-11) | Styrene/hydrogenated styrene syn-copolymer | (95/5) |
| (CP-12) | Styrene/hydrogenated styrene syn-copolymer | (93/7) |
| (CP-13) | Styrene/hydrogenated styrene syn-copolymer | (85/15) |
| (CP-14) | Styrene/hydrogenated styrene syn-copolymer | (80/20) |
| (CP-15) | Styrene/hydrogenated styrene/p-methylstyrene syn-copolymer | (90/5/5) |
| (CP-16) | Styrene/hydrogenated styrene/p-methylstyrene syn-copolymer | (86/7/7) |

In place of use of the above-mentioned copolymer, a syndiotactic styrenic polymer can be used in combination with another polymer.

The combinations of two polymers for the polymer mixture include the following (5), (6), (7) and (8). The combinations of three or more polymers for the mixture can be obtained by further combining the following (5) to (8). The combinations of copolymers can also be obtained by combining the above-mentioned copolymers (1) to (4) with the following (5) to (8).

(5) Polystyrene and another styrenic polymer (6) Polystyrene and another vinyl polymer (7) Two styrenic polymers other than polystyrene (8) Styrenic polymer other than polystyrene and another vinyl polymer The combinations (5) and (6) are preferred. The combination (8) is most preferred.

Polystyrene and styrenic polymers have the syndiotactic structure. However, the whole polymers contained in the mixture preferably have a syndiotactic structure.

In the case of the combination (4), the ratio of syndiotactic polystyrene in the mixture is preferably in the range defined in the following formula (IIa):

$$100-\sqrt{30\times(T-85)} \leqq SPS \leqq 100-\sqrt{\frac{T-85}{100}} \quad \text{(IIa)}$$

In the formula (IIa), SPS means the ratio (wt. %) of polystyrene in the mixture, and T means the thickness (μm) of the support.

The ratio of polystyrene in the mixture is more preferably in the range defined in the following formula (IIb), and most preferably in the range defined in the formula (IIc):

$$100-\sqrt{20\times(T-85)} \leqq SPS \leqq 100-\sqrt{\frac{T-85}{50}} \quad \text{(IIb)}$$

$$100-\sqrt{10\times(T-85)} \leqq SPS \leqq 100-\sqrt{\frac{T-85}{10}} \quad \text{(IIc)}$$

In the formulas (IIb) and (IIc), SPS and T have the same meanings as defined in the formula (IIa).

Examples of the preferred polymer mixtures are shown below. In the following examples, the term "syn-" means syndiotactic (structure), and the term "atc-" means atactic (structure).

FIG. 1 is a graph showing a preferred range of styrene content in a copolymer or a polymer mixture. The ordinate means the styrene content in the polymer or the mixture, and the abscissa means the thickness of the support. In the FIG. 1, A is the upper limit of the styrene content defined in the formula (Ia) or (IIa), B is the upper limit defined in the formula (Ib) or (IIb), C is the upper limit defined in the formula (Ic) or (IIc), c is the lower limit defined in the formula (Ic) or (IIc), b is the lower limit defined in the formula (Ib) or (IIb), and a is the lower limit defined in the formula (Ia) or (IIa).

As is defined in the formulas (Ia) to (IIc) and is shown in FIG. 1, the contents of the components other than styrene can be increased according to the increase of the thickness of the support.

The spherulites in plastic are formed in the case that the growth speed of the spherulite is faster than the cooling speed of melt, which is the melted plastic polymer extruded on a casting drum. Accordingly, spherulites tend to be formed in a thick support, which requires a long time for cooling. Further, spherulites tend to be formed in a syndiotactic polystyrene. Therefore, the content of the styrene unit is defined above as a function of the thickness of the support. The content means wt. % of the styrene unit per the total weight of the copolymer or the polymer mixture.

In the case that the styrene content in the copolymer or the polymer mixture is higher than the upper limit defined above, spherulites are remarkably formed. In the case that the styrene content is lower than the lower limit, the effect of the syndiotactic polymer (high dimensional stability to humidity change) is degraded.

The spherulites are scarcely formed in such a thin support that the thickness after biaxially stretching is less than 90 μm. However, it is difficult to handle the thin support because the mechanical strength support is poor. The present invention is particularly effective in the case that the thickness of the support is not less than 90 μm.

The thickness of the support is generally in the range of 90 to 250 μm, preferably in the range of 94 to 230 μm, and more preferably in the range of 98 to 200 μm.

| Mixture | Units | Mixing ratio (wt. %) |
|---|---|---|
| (PM-1) | Syn-polystyrene + syn-poly-p-methylstyrene | (95 + 5) |
| (PM-2) | Syn-polystyrene + syn-poly-p-methylstyrene | (93 + 7) |
| (PM-3) | Syn-polystyrene + syn-poly-p-methylstyrene | (85 + 15) |
| (PM-4) | Syn-polystyrene + syn-poly-p-methylstyrene | (80 + 20) |
| (PM-5) | Syn-polystyrene + syn-poly-p-chlorostyrene | (90 + 10) |
| (PM-6) | Syn-polystyrene + syn-poly-p-chlorostyrene | (85 + 15) |
| (PM-7) | Syn-polystyrene + syn-polyhydrogenated styrene | (90 + 10) |
| (PM-8) | Syn-polystyrene + syn-polyhydrogenated styrene | (85 + 15) |
| (PM-9) | Syn-polystyrene + atc-polystyrene | (90 + 10) |
| (PM-10) | Syn-polystyrene + atc-polystyrene | (85 + 15) |
| (PM-11) | Syn-polystyrene + atc-polystyrene + syn-poly-p-methylstyrene | (90 + 5 + 5) |
| (PM-12) | Syn-polystyrene + atc-polystyrene + syn-poly-p-methylstyrene | (86 + 7 + 7) |
| (PM-13) | Syn-polystyrene + styrene/p-methylstyrene syn-copolymer (copolymerization wt. % ratio = 95/5) | (70 + 30) |
| (PM-14) | Syn-polystyrene + styrene/p-methylstyrene syn-copolymer (copolymerization wt. % ratio = 95/5) | (60 + 40) |
| (PM-15) | Syn-polystyrene + styrene/p-methylstyrene syn-copolymer (copolymerization wt. % ratio = 95/5) | (55 + 45) |
| (PM-16) | Syn-polystyrene + styrene/p-methylstyrene syn-copolymer (copolymerization wt. % ratio = 95/5) | (50 + 50) |
| (PM-16) | Syn-polystyrene + styrene/p-methylstyrene syn-copolymer (copolymerization wt. % ratio = 90/10) | (70 + 30) |
| (PM-16) | Syn-polystyrene + styrene/p-methylstyrene syn-copolymer (copolymerization wt. % ratio = 95/5) | (60 + 40) |

The molecular weight of the styrenic polymer in terms of weight average molecular weight is preferably in the range of 100,000 to 800,000, and more preferably in the range of 200,000 to 600,000. The distribution of the molecular weight in terms of weight average molecular weight (Mw) per number average molecular weight (Mn) is preferably in the range of 1.5 to 5, and more preferably in the range of 2 to 4.

The syndiotactic styrenic polymer can be synthesized by polymerization of styrene monomer (corresponding to the styrenic polymer) in an inert hydrocarbon solvent. In the polymerization, a titanium compound and a condensate of water with a trialkylaluminum are used as catalysts, as is described in Japanese Patent Provisional Publication No. 61(1987)-187708. The synthesis can also be conducted in the absence of the solvent. A titanium compound and a compound of an anion with a cation having two or more functional group attached to one atom can also be used as catalysts, as is described in Japanese Patent Provisional Publication No. 4(1992)-249504.

The other additives can be added to the plastic support so long as the object of the present invention (i.e., transmittance of ultraviolet) is attained. Examples of the additives include inorganic particles (e.g., silica, talk, titania, alumina, calcium carbonate, calcium oxide, calcium chloride and mixtures thereof), organic particles cross-linked polystyrene, cross-linked polymethyl methacrylate), antioxidants, antistatic agents and dyes.

The remaining amount of styrene monomer in plastic is preferably not more than 7,000 ppm to prevent precipitation of the monomer in the formation of a film. In more detail, the following method (1) or (2) is preferably used.

(1) The styrenic polymer is dried under reduced pressure after polymerization or treatment. The drying temperature is preferably higher than the glass-transition temperature of the polymer.

(2) The plastic is degassed in a extruding machine to obtain pellets. The machine preferably has a vent. A single or double screw extruding machine is available.

A plastic film is formed from the styrenic polymer or a mixture thereof. In more detail, the plastic is heated to melt it, extruded, and then cooled to harden it. Thus a raw plastic film is obtained. The raw film is conveyed on a roller, and stretched.

In the present invention, a support of high ultraviolet transmittance is obtained by improving the above-mentioned process for the preparation of the plastic film. The point of the process is to reduce the formation of the spherulites from the extruding step to the stretching step. In more detail, both number and size of the spherulites should be reduced.

The plastic support preferably does not contain spherulites having a diameter in the range of 0.05 to 5 μm to obtain a high ultraviolet transmittance. The amount of the spherulites preferably is not more than 30%, more preferably is not more than 20%, and most preferably is not more than 10% based on the volume amount of the support. The spherulites having a diameter in the range of 0.05 to 5 μm (particularly 0.1 to 3 μm, and more particularly 0.2 to 2 μm) reduces the ultraviolet transmittance. Accordingly, the occurrences of the spherulites having such a diameter should particularly be inhibited.

The size and the volume ratio of the spherulites are easily measured by a polarizing microscope. In more detail, the support is photographed through the polarizing microscope, after biaxially stretching and thermal fixing. The spherulites having the above-mentioned diameter are selected from the photograph. The volume ratio is calculated by dividing the total sectioned area by the split field in the eye piece. The volume ratio is usually expressed as percentage.

The process of the preparation of the support and the means for reducing spherulites are described below in more detail.

The residence time of pellet in the extruding machine is preferably in the range of 5 to 60 minutes, more preferably in the range of 8 to 40 minutes, and most preferably in the range of 11 to 25 minutes. Before extruding, the pellet is usually heated to remove water, which causes hydrolysis. The spherulites are formed at heating the pellet. If the spherulites are not completely melted at the next stage, the remaining spherulites function as cores of larger spherulites. The spherulites grow at a high speed in the syndiotactic polymer of the present invention. Accordingly, the problem is serious in the invention. Therefore, the spherulites should be completely melted in the extruding machine. Thus, the number of the spherulites can be reduced. If the residence time in the extruding machine is less than 5 minutes, the spherulites cannot be completely melted. If the residence time is more than 60 minutes, the polymer is thermally decomposed to form insoluble components, which function as cores of new spherulites.

The temperature in the extruding machine is preferably higher than the melting point of the polymer plus 30° C., more preferably higher than the melting point plus 40° C., and most preferably higher than the melting point plus 60° C. If the temperature is extremely low, the spherulites are not melted. On the other hand, an extremely high temperature causes insoluble components, which function as cores of new spherulites. Therefore, the temperature is preferably lower than the melting point of the polymer plus 120° C., more preferably lower than the melting point plus 110° C., and most preferably lower than the melting point plus 100° C.

A single or double screw extruding machine is available. In the case that a polymer mixture is used to form a film, a double screw extruding machine is advantageously used to mixing polymers uniformly. The extruding machine preferably has a vent.

The extruded melt is quickly cooled to inhibit the growth of the spherulites, namely to control the size of the spherulites. The spherulites are frequently formed between the T-die of the extruding machine and the cooling casting drum. The time between them is preferably short as possible. The time is preferably in the range of 0.01 to 2 seconds, more preferably in the range of 0.01 to 1 second, and most preferably in the range of 0.01 to 0.5 second. The time is shortened by increasing the extruding speed of the machine or arranging the T-die and the casting drum closely. The latter method is preferred, because it is rather inexpensive.

The extruded melt is immediately cooled to a temperature of lower than the crystallizing temperature. The growth of the spherulites is inhibited at a low temperature. However, die lines are formed at such a low temperature. The die lines are formed on the surface of the cast film corresponding to the rough surface of the T-dye. On the other hand, the die lines are scarcely formed, but the spherulites are frequently formed at a high temperature. The temperature of the casting drum is preferably in the range of 25° C. to the glass transition point of the polymer plus 20° C., more preferably in the range of 40° C. to the glass transition point plus 10° C., and most preferably in the range of 50° C. to the glass transition point.

The temperature of the casting drum is controlled by a cooling medium, which may be air or liquid. The roll of the casting drum is preferably made of a metal having a high thermal conductivity. The casting drum may have means for improving the surface smoothness of the cast melt. Examples of such means include an air knife, an air chamber, a touch roll and an applied static charge. The method of applying a static charge is most preferred.

The raw sheet is conveyed on a roll to a stretching machine (described below). In the present invention the sheet is preferably conveyed on the roll having a diameter of 50 to 1,000 mm at a temperature in the range of the glass transition point minus 70° C. to the glass transition point plus 20° C. The crazing (minute crack formed on the surface of the sheet) can be inhibited by the above-mentioned conveying conditions.

The crazing scatters light, particularly ultraviolet having a short wave length. Therefore, the crazing decreases the ultraviolet transmittance. The crazing problem has scarcely been reported where a polyethylene terephthalate film is conventionally used as the photographic support. The problem accompanies the syndiotactic styrenic polymer. The crazing is observed when the support is conveyed on a rolled. The outer surface of the support on the roll is extended compared with the inner surface. The crazing is caused in the case that the extension is larger than the breaking extension of the support. The breaking extension of the SPS support is extremely smaller than that of the PET support. Therefore, a small curve on the roll may cause the crazing.

Further, the crazing is caused on a thick support. The crazing is remarkably observed in the support having the thickness of more than 1 mm. Therefore, the conditions for handling the thick support, particularly conveying the raw film should be controlled to inhibit the crazing.

The crazing caused in the raw film is enlarged or increased at the stretching stage. Therefore, the crazing should be inhibited, even if the crazing size is small.

The crazing can be inhibited by (a) reducing the curl of the conveying the raw support to decreasing the deformation (extension of the outer surface) or (b) softening the support to increase the breaking extension.

According to the method of (a), the sheet is conveyed on the roll having a diameter of 50 to 1,000 mm. The diameter is preferably in the range of 80 to 800 mm, and more preferably in the range of 100 to 500 mm. The crazing can be inhibited by use of the roll having a diameter of not less than 50 mm. On the other hand, a roll of more than 1,000 mm is too large to construct a compact apparatus. The wrap angle at the conveying stage is preferably in the range of 60 ° to 240°, more preferably in the range of 70° to 220°, and most preferably in the range of 80° to 200°. The crazing tends to be caused where the wrap angle is more than 240°. The wrap angle of less than 60° causes a problem such as a slip while conveying the support to cause a scratch on the sheet.

According to the method of (b), the sheet is conveyed on the roll at a temperature in the range of the glass transition point (Tg) minus 70° C. (Tg−70) to the glass transition point plus 20° C. (Tg+20). The temperature is preferably in the range of Tg−60 to Tg+10, and more preferably in the range of Tg−50 to Tg+5.

The conveyed raw sheet is then stretched. The photographic support requires uniformity along the longitudinal and lateral directions. Accordingly, the photographic support is preferably subjected to multi-axial stretching along the directions. The multi-axial stretching can be conducted by a simultaneous or successive stretching method. The successive stretching method is preferred because it can be conducted in a small apparatus.

The sheet can be stretched by a tenter. The sheet can also be stretched between rolls. Further, the support can be milled to conduct stretching. Two or more methods can be used in combination. The tenter and rolls are preferably used. The support is preferably stretched along the longitudinal direction between rolls, and then stretched along the lateral direction by a tenter. The support may be further stretched along the longitudinal or lateral direction once or more.

The stretching temperature (along the longitudinal or lateral direction) is preferably in the range of the glass transition point (Tg) of the raw sheet to the glass transition point plus 50° C. (Tg+50), more preferably in the range of Tg to Tg+40, and most preferably in the range of Tg+5 to Tg+30.

The stretching speed (along the longitudinal or lateral direction) is preferably in the range of 1,000 to 8,000% per minutes, more preferably in the range of 2,000 to 6,000% per minutes, and most preferably in the range of 2,500 to 4,000% per minutes.

The area stretching degree is preferably in the range of 10 to 16 times, more preferably in the range of 11 to 15 times, and most preferably in the range of 12 to 14.5 times.

The stretched film is usually subjected to a heat setting. The heat setting can be conducted while stretching the sheet. It can also be conducted while relaxing the sheet. The relaxation ratio is preferably not more than 30%, more preferably not more than 20%, and most preferably not more than 15%. If the thermal relaxation ratio at the heat setting stage is more than 30%, the flatness of the sheet is degraded.

The thermal relaxation can easily conducted by controlling the width of the tenter used at the heat setting.

The heat setting temperature is preferably in the range of 200° C. to the melting point of the film, more preferably in the range of 220° C. to the melting point, and most preferably in the range of 230° C. to the melting point. The heat setting is preferably conducted for 3 to 60 seconds, more preferably for 5 to 40 seconds, and most preferably for 10 to 30 seconds.

The heat setting can be conducted twice or more while changing the heating conditions.

Figure 2:
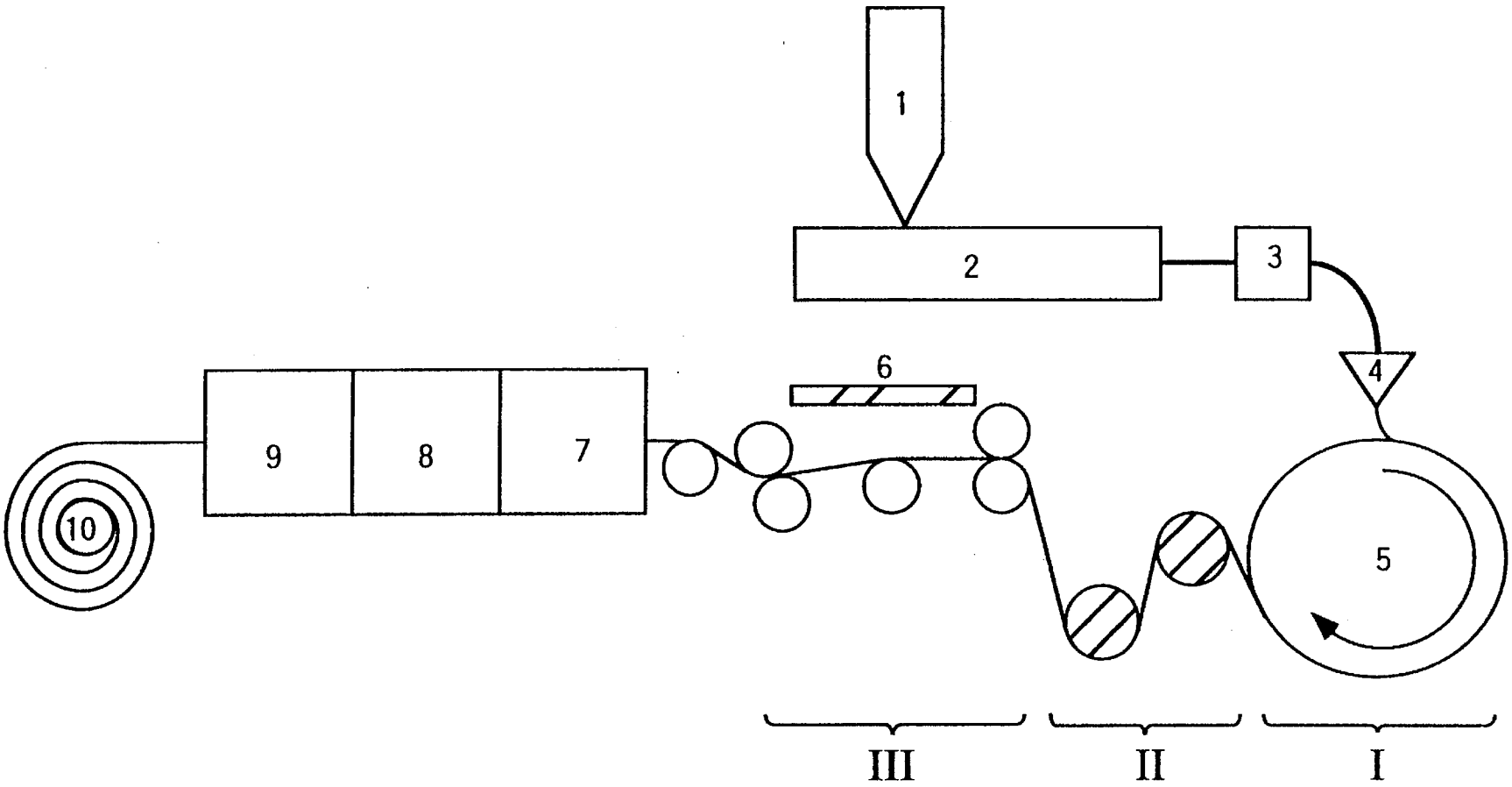
FIG. 2 is a flow chart schematically illustrating the process for the preparation of the plastic support.

FIG. 2 is a flow chart schematically illustrating the process for the preparation of the plastic support.

As is shown in FIG. 2, a melted plastic is fed from a hopper (1) to a extruding machine (2). The plastic is then extruded from the machine (2) through a filter (3). The extruded plastic is then coated on a casting drum (5) with a T-die (4). At the cooling step (I), a raw plastic film is cooled on the casting drum. The film is then conveyed on rollers at the conveying step. According to the present invention, the conveying rollers used at the conveying step (II) preferably have a heater to control the temperature. The conveyed sheet is then stretched along the longitudinal direction. An infrared heater (6) is preferably used at the longitudinal stretching step (III). The sheet is introduced into a tenter zone (7), and is subjected to the lateral stretching. The sheet is then introduced into a heat setting zone (8) and a thermal relaxation zone (9). The sheet is then wound up by a take-up machine (10).

The support preferably has an expansion coefficient to humidity in the range of $1\times10^{-6}$/% RH to $8\times10^{-6}$/% RH. The coefficient is more preferably in the range of $1.2\times10^{-6}$/% RH to $5\times10^{-6}$/% RH, and most preferably in the range of $1.4\times10^{-6}$/% RH to $2.5\times10^{-6}$/% RH.

Further, the support preferably has the following thickness patterns (a) to (d).

(a) The difference of the maximum TD R value and the minimum TD R value along the width direction is in the range of 0 to 6 μm.

(b) The difference of the maximum MD R value and the minimum MD R value along the length direction is in the range of 0 to 6 μm.

(c) The difference of MID and TD in the thickness between the neighboring convex and concave is 0 to 6 μm.

(d) The difference of the maximum value of the convex or the concave and the base line, which is the average thickness at the both sides of the sheet is 0 to 5 μm.

The support having the above-mentioned thickness patterns can be obtained by heating the support at a temperature higher than the glass transition point plus 50° C. before coating a silver halide emulsion.

The support preferably has a thermal shrinkage ratio of not more than 0.4% at 110° C. for 30 minutes.

The support of the present invention may be subjected to a glow discharge treatment, a corona discharge treatment, an ultraviolet treatment or a flame treatment. The corona discharge treatment is most preferred because it increases the adhesion of the support effectively.

The corona discharge treatment, the ultraviolet treatment, the glow discharge treatment and the flame treatment are described below.

The corona discharge treatment has been well known. The treatment can be performed by the processes described in Japanese Patent Publications No. 48(1973)-5043, No. 47(1972)-51905, No. 47(1972)-28067, No. 49(1974)-83767, No. 51(1976)-41770 and No. 51(1976)-131576. A discharge frequency is generally 50 Hz to 5,000 kHz and preferably 5 to 100 kHz. The treatment strength preferably is 0.001 to 5 KV·A·minute/$m^2$, and more preferably is 0.01 to 1 KV·A·minute/$m^2$. A gap clearance between an electrode and a dielectric roll generally is in the range of 0.5 to 2.5 mm, and preferably in the range of 1.0 to 2.0 mm.

The ultraviolet treatment is performed according to the known methods described in Japanese Patent Publications No. 41(1966)-10385, No. 43(1968)-2603, No. 43(1968)-2604 and No. 45(1970)-3828. A high pressure or low pressure mercury lamp of a quarts tube having a main wavelength in the range of 180 to 380 nm is preferably used as the light source.

The amount of a light generally is 20 to 10,000 mJ/$cm^2$ in the case of using the high pressure mercury vapor lamp of a main wavelength of 365 nm, and preferably 50 to 2,000 mJ/$cm^2$. The amount of a light generally is 100 to 10,000 mJ/$cm^2$ in the case of using the low pressure mercury vapor lamp of a main wavelength of 365.nm, and preferably 300 to 1,500 mJ/$cm^2$.

The glow discharge treatment has been known, and is described in Japanese Patent Publications No. 35(1960)-7578, No. 36(1961)-10336, No. 45(1970)-22004, No. 45(1970)-24040, No. 46(1971)-43480, Japanese Patent Provisional Publication No. 53(1978)-129262, U.S. Pat. Nos. 3,057,792, 3,057,795, 3,179,482, 3,288,638, 3,309,299, 3,424,735, 3,462,335, 3,475,307, 3,761,299, 4,072,769, British Patents No. 891,469 and No. 997,093.

The glow discharge treatment is particularly effective in a vapor atmosphere to obtain a strong adhesion. The vapor atmosphere is also effective in inhibiting a yellowish coloring of the support or inhibiting blocking.

The partial pressure of the vapor at the glow discharge treatment is preferably in the range of 10 to 100%, and more preferably in the range of 40 to 90%. In the case that the pressure is less than 10%, it is difficult to obtain a sufficient adhesion. The gas other than vapor is the air comprising oxygen and nitrogen.

The glow discharge treatment is preferably conducted under a reduced pressure while heating the support to shorten the treatment time and to increase the adhesion effectively.

The preheat temperature is preferably in the range of 50° C. to the glass transition point (Tg), more preferably in the range of 60° C. to Tg, and most preferably in the range of 70° C. to Tg. In the case that the temperature is higher than Tg, the adhesion is degraded.

With respect to the glow discharge treatment conditions, pressure is preferably in the range of 0.005 to 20 Torr, and more preferably in the range of 0.02 to 2 Torr.

The voltage is preferably in the range of 500 to 5,000 V, and more preferably in the range of 500 to 3,000 V.

A discharge frequency preferably is in the range of 0 (i.e., a direct current) to several handled MHz, more preferably in the range of 50 Hz to 20 MHz, and most preferably in the range of 1 Hz to 1 MHz.

The strength of a discharge treatment preferably is in the range of 0.01 to 5 KV·A·minute/$m^2$ and more preferably in the range of 0.15 to 1 KV·A·minute/$m^2$ because of obtaining a desired adhesion strength.

Immediately after the glow discharge treatment, the support is preferably cooled using cooling rolls.

The flame treatment is conducted by use of a natural gas or a liquid propane gas. The ratio of the gas to the air is important. The volume ratio of the propane gas to the air is preferably in the range of 1/14 to 1/22, and more preferably in the range of 1/16 to 1/19. The volume ratio of the natural gas to the air is preferably in the range of 1/6 to 1/10, and more preferably in the range of 1/7 to 1/9.

The flame treatment is preferably conducted in the range of 1 to 10 Kcal/$m^2$, and more preferably in the range of 3 to 30 Kcal/$m^2$. The distance between the flame of the burner is preferably not longer than the 4 cm. The treatment apparatus is available from Kasuga Electric Co., Ltd. The backup roll for the support preferably is a hollow roll containing cooling water to keep a constant temperature.

The undercoating layers may be provided between the surface treated support and the silver halide emulsion layer. The undercoating layer may comprise a first coating layer and a second under coating layer. The first coating layer adheres to the support, and the second coating layer adheres to the silver halide emulsion layer.

The first undercoating layer may contain an epoxy resin, gelatin, nitrocellulose, polyvinyl acetate or other polymers. The polymers may be made from vinyl chloride, vinylidene chloride, butadiene, vinyl acetate, styrene, acrylonitrile, methacrylic ester, methacrylic acid, iraconic acid or maleic anhydride. If necessary, the first undercoating layer may contain a cross-linking agent (e.g., triazine compounds, epoxy compounds, melamine compounds, isocyanate compounds such as block isocyanate, aziridine compounds, oxazoline compounds), inorganic particles (e.g., colloidal silica), surface active agents, adhesive agents, dyes or preservatives. These additives are described in H. H. Immergut, Polymer Handbook, VI 1867 to 231, Interscience, Pub. New York (1966), Japanese Patent Provisional Publications No. 50(1975)-39528, No. 50(1975)-47196, No. 50(1975)-63881, No. 51(1976)-133526, No. 64(1989)-538, No. 63(1988)-174698, No. 3(1991)-109545, No. 1(1989)-240965, No. 2(1990)-184844, No. 48(1963)-89870 and No. 48(1973)-93672. The second undercoating layer substantially consists of gelatin.

In the case that the undercoating layer consists of a single layer, the support is swelled to mixing the polymers of the support and the undercoating layer along the interface. Thus the adhesion along the interface is increased. Examples of the undercoating polymers include a water soluble polymer, cellulose ester, a latex polymer and a water soluble polyester. Examples of materials for the water soluble polymer include gelatin, gelatin derivatives, casein, agar, sodium alginate, starch, polyvinyl alcohol, an acrylic acid-containing copolymer and a maleic anhydride-containing copolymer. Examples of materials for the latex polymer include a vinyl chloride-containing copolymer, a vinylidene chloride-containing copolymer, an acrylic acid ester-containing copolymer, a vinyl acetate-containing copolymer and a butadiene-containing copolymer. Gelatin is most preferred. Lime-treated gelatin, acid-treated gelatin, enzyme-treated gelatin, gelatin derivative and denatured gelatin are available. Lime-treated gelatin and acid-treated gelatin are particularly preferred.

The hydrophilic colloidal layers is described below.

The hydrophilic colloidal layers include a silver halide emulsion layer, a protective layer, an intermediate layer, an antihalation layer, a backing layer and a protective backing layer.

The most preferred hydrophilic colloid is gelatin. Lime-treated gelatin, acid-treated gelatin, enzyme-treated gelatin, gelatin derivative and denatured gelatin are available. Lime-treated gelatin and acid-treated gelatin are particularly preferred. Other hydrophilic colloids are also available. Examples of the hydrophilic colloids include colloidal albumin, casein, agar, sodium alginate, starch derivatives, carboxymethyl cellulose, hydroxymethyl cellulose, polyvinyl alcohol, poly-N-vinyl pyrrolidone, polyacrylamide amide and copolymers thereof. Two or more polymers may be used in combination.

The hydrophilic colloidal layer may comprises two or more layers. The thickness of the layer is usually in the range of 0.01 to 10 μm, and more preferably in the range of 0.1 to 7 μm.

The total thickness of the two or more hydrophilic colloidal layers is preferably in the range of 1.5 to 10 μm on the emulsion side or in the range of 5 to 5 μm on the backing side.

The backing layers are describe below. The backing layers include a hydrophilic layer and a hydrophobic layer. In the case that hydrophilic and hydrophobic layers are provided, the hydrophobic layer is provided on the hydrophilic layer.

(1) Hydrophilic backing layer

Hydrophilic backing layer consists of a hydrophilic colloid. The hydrophilic layer functions as an anti-curl layer which compensates the curl caused by the shrinkage of the hydrophilic colloid contained in photographic layers. Examples of the hydrophilic colloids are the same as the examples of the colloids used in the photographic layers. The coating amount is preferably so adjusted that the ratio of the coating amount of the hydrophilic colloid contained in the backing layers to the coating amount of the hydrophilic colloid contained in the photographic layers is not more than 0.5. The coating amount means the total amount of the backing layers or the photographic layers. The coating amount also means the total amounts of two or more hydrophilic colloids, in the case that two or more colloids are used in a single layer or two or more layers.

A polymer latex may be added to the hydrophilic backing layer. The polymer latex is an aqueous dispersion of a water-insoluble polymer. The average particle size of the latex is preferably in the range of 20 to 200 μm, The dry amount ratio of the latex to a binder is preferably in the range of 0.01 to 1.0, and more preferably in the range of 0.1 to 0.8. The polymers in the latex are preferably made from alkyl acrylates, hydroxyalkyl acrylates, glycidyl acrylates, alkyl methacrylates, hydroxyalkyl methacrylates and glycidyl methacrylates. The average molecular weight of the polymer is preferably not less than 100,000, and more preferably in the range of 300,000 to 500,000. Examples of the polymers are shown below.

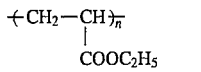
(Polymer 1)

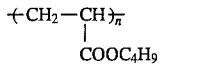
(Polymer 2)

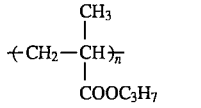
(Polymer 3)

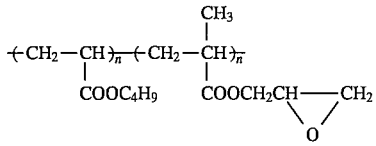
(Polymer 4)

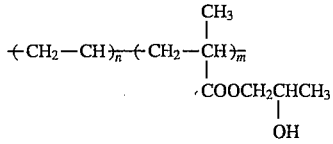
(Polymer 5)

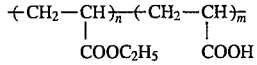
(Polymer 6)

(2) Hydrophobic backing layer

The hydrophobic backing layer functions as a water-resistant layer. The hydrophobic layer preferably has a function of not passing water but passing vapor. The layer preferably is substantially water-resistant. The substantial water-resistance means that the swelling ratio about the thickness is not more than 1.3 where the layer is immersed in water at 25° C. for 1 minute. The swelling ratio is preferably not more than 1.1.

In the case that the hydrophilic layer and the hydrophobic layer are provided on the support, the swelling ratio about the total thickness of the layers is preferably not more than 1.5, and more preferably is not more than 1.3 where the layers are immersed in water at 25° C. for 1 minute. The increase of the thickness preferably is not more than 2 μm, and more preferably is not more than 1 μm after the layers are immersed in water.

The hydrophobic layer can be formed by coating and drying a latex. The polymers of the latex are preferably made from ethylene, vinyl chloride, urethane, vinylidene chloride, vinylidene fluoride, butadiene, acrylamides, acrylic esters, α-alkyl-substituted acrylic esters or styrenes.

Examples of the acrylamides, acrylic esters, α-alkyl-substituted acrylic esters and styrenes are shown below.

(1) Acrylamides

N,N-dibutylacrylamide, N-phenylacrylamide, N,N-diphenylmethacrylamide, N,N-octylacrylamide, N,N-cyclohexylmethacrylamide (2) Acrylic esters Methyl acrylate, ethyl acrylate, propyl acrylate, butyl acrylate, hexyl acrylate, 2-ethylhexyl acrylate (3) α-alkyl-substituted acrylic esters Methyl methacrylate, ethyl methacrylate, propyl methacrylate, butyl methacrylate, 2-cyclohexyl methacrylate, methyl ethacrylate, butyl ethacrylate (4) Styrene and styrene derivatives Styrene, α-methylstyrene, p-hydroxystyrene, p-chlorostyrene, 2,4-dichlorostyrene The molecular weight of the polymer is preferably in the range of 2,000 to 1,000,000, and more preferably in the range of 5,000 to 200,000.

Examples of the preferred latex polymers are shown below.

(LP-1)

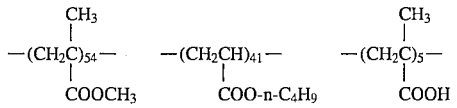

(Average particle size: 0.12 μm)

(LP-2)

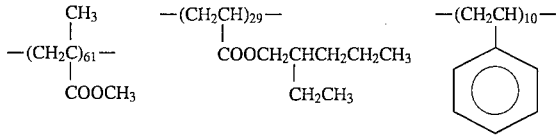

(Average particle size: 0.20 μm)

(LP-3)

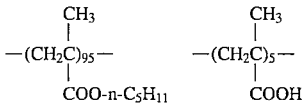

(Average particle size: 0.08 μm)

(LP-4)

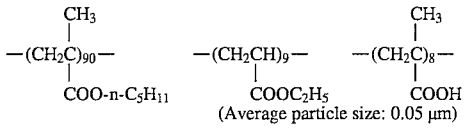

(Average particle size: 0.05 μm)

(LP-5)

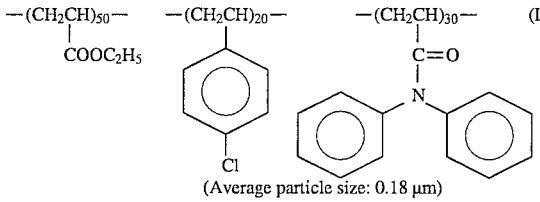

(Average particle size: 0.18 μm)

(LP-6)

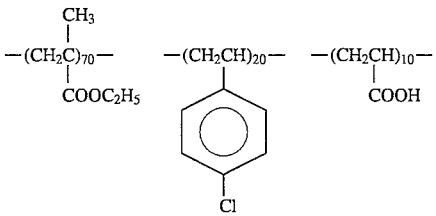

(Average particle size: 0.05 μm)

(LP-7)

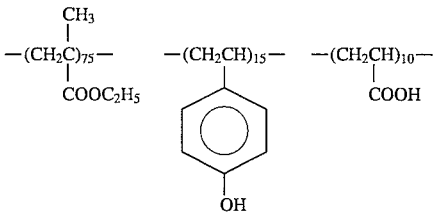

(Average particle size: 0.03 μm)

(LP-8)

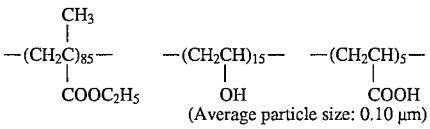

(Average particle size: 0.10 μm)

(LP-9)

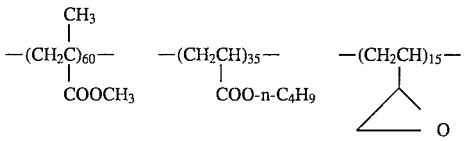

(Average particle size: 0.10 μm)

(LP-10)

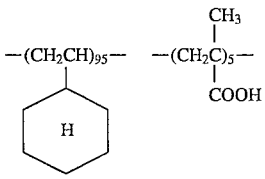

(Average particle size: 0.12 μm)

(LP-11)

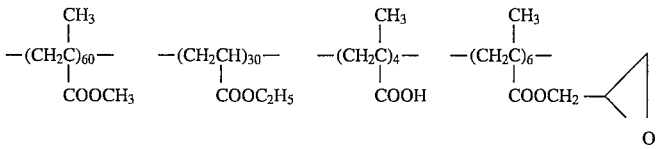

(Average particle size: 0.10 μm)

The polymer may be in the form of a copolymer, which can be formed from the above-mentioned monomer with another monomer. Examples of the other monomers include acrylic acid, methacrylic acid and iraconic acid. The other vinyl monomer (e.g., divinylbenzene) is also available in the copolymer.

Two or more latex polymers may be used in combination.

The average particle size of the latex is preferably in the range of 0.01 to 0.5 μm, and more preferably in the range of 0.02 to 0.2 μm.

The glass transition point of the layer is preferably in the range of 10° to 150 ° C.

The backing layer may contain a plasticizer. Examples of the plasticizers include phthalic esters (e.g., dibutyl phthalate, diisooctyl phthalate, diphenyl phthalate), glycol derivatives (e.g., diethylene glycol, diethylene glycol dioctyl ether, triethylene acetate glycol), phosphoric esters (e.g., triphenyl phosphate, tridecyl phosphate) and ketones (e.g., cyclodekanone, n-octadecanone, n-octadekane-3,6,9-trione). Two or more plasticizers may be used in combination.

The amount of the plasticizer is preferably in the range of 0.1 to 100 wt. %, and more preferably in the range of 3 to 10 wt. % based on the solid content of the polymer.

An organic solvent having a boiling point of lower than 250° C. may be added to the polymer latex.

Examples of the organic solvents include cellosolves (e.g., ethylcellosolve, butylcellosolve), alcohols (e.g., isopropanol, n-butanol, sec-butanol, furfuryl alcohol), glycols (e.g., ethylene glycol monobutyl ether, diethylene glycol monoethyl ether, ethyl acetate glycol monoethyl ether).

Two or more organic solvents may be used in combination.

Two or more polymer layers may be provided on the support as the backing layers. The thickness of the hydrophobic polymer layer (the total thickness of two or more layers) is preferably in the range of 0.05 to 10 μm, and more preferably in the range of 0.1 to 5 μm. glycol, diethylene glycol dioctyl ether, triethylene acetate glycol).

The backing layers may further contain a matting agent, a slipping agent, an antistatic agent, a surface active agent, a cross-linking agent and an electroconductive substance.

The backing layers may be coated on the support according to conventional methods, such as a dip coating method, an air knife coating method, a curtain coating method, a roller coating method, a wire bar coating method, a gravure coating method, an extrusion coating method and a simultaneous multi-layered coating method. The extrusion method using a hopper is described in U.S. Pat. No. 2,681,294. The simultaneous coating method is described in U.S. Pat. Nos. 2,761,418, 3,508,947 and 2,761,791. Examples of the latex are shown below.

The silver halide emulsion is usually prepared from a reaction of a water-soluble silver salt (e.g., silver nitrate) with a water-soluble halide salt (e.g., potassium bromide) in an aqueous solution of a water-soluble polymer (e.g., gelatin).

Silver chloride, silver bromide, silver chlorobromide, silver iodobromide and silver chloroiodobromide are available able. There is no specific limitation with respect to the grain shape and the grain size distribution.

The silver halide emulsion layer may further contain a chemical sensitizer, a spectral sensitizer, an antifogging agent, a hydrophilic colloid (e.g., gelatin), a hardening agent for gelatin, a surface active agent and an adhesive agent. The additives are described in Research Disclosure, volume 176, item 17643 (December 1978), and Japanese Patent Provisional Publications No. 52(1977)-108130, No. 52(1977)-114328, No. 52(1977)-121321, No. 53(1978)-3217 and No. 53(1978)-44025.

If necessary, the photographic material of the present invention may has a surface resistance of not higher than $10^{12}$.

Various means are available for decreasing the surface resistance. For example, Japanese Patent Provisional Publications No. 58(1983)-62648, No. 58(1983)-62649 and No. 51(1976)-115291 disclose a method of adding fine oxide particles of Sn, Zn, Ti, In or V. Japanese Patent Provisional Publications No. 57(1982)-204540 and No. 54(1979)-133324 disclose a method of adding a polymer. Japanese Patent Provisional Publications No. 64(1989)-26849 and No. 61(1986)-24907 disclose a method of adding a surface active agent. A metal oxide such as $SnO_2$ is preferably used.

An electroconductive crystal of oxide or a complex oxide thereof is preferably used as the fine metal oxide particle.

The fine metal oxide particles preferably have a volume resistance of not higher than $10^7\Omega$, and more preferably not higher than $10^5\Omega$. The particle size is preferably in the range of 0.01 to 0.7 μm, and more preferably in the range of 0.02 to 0.5 μm.

The process for the preparation of the fine metal oxide particles is described in Japanese Patent Provisional Publication No. 56(1981)-143430. The metal particles may be prepared in the presence of a hetero atom. The hetero atom is incorporated into the particles to increase the conductivity. Further, an oxygen defect may be introduced into the fine particles. ZnO particles may contain Al or In. $TiO_2$ particles may contain Nb or Ta. $SnO_2$ particles may contain Sb, Nb or a halogen atom. The amount of the hetero atom is preferably in the range of 0.01 to 30 mol %, and more preferably in the range of 0.1 to 10 mol %.

$SnO_2$ particles containing Sb is particularly preferred.

A non-light-sensitive hydrophilic colloidal layer may be provided on the photographic material. The colloidal layer usually contains a dye. Various dyes are available. For example, U.S. Pat. Nos. 3,455,693, 2,548,564, 4,124,386, 3,625,694, Japanese Patent Provisional Publications No. 47(1972)-13935, No. 55(1980)-33172, No. 56(1981)-36414, No. 57(1982)-161853, No. 52(1977)-29727, No. 61(1986)-198148, No. 61(1986)-177447, No. 61(1986)-217039 and No. 61(1986)-219039 disclose dyes adsorbed on mordents. Japanese Patent Provisional Publications No. 61(1986)-213839, No. 63(1988)-208846, No. 63(1988)-296039 and No. 1(1989)-15439 disclose nondiffusion dyes. Japanese Patent Provisional Publication No. 3(1991)-109535 discloses dyes dissolved in oil which is dispersed in a layer. U.S. Pat. Nos. 2,719,088, 2,498,841, 2,496,843, Japanese Patent Provisional Publications No. 60(1985)-45237 and No. 3(1991)-5748 disclose dyes adsorbed on the surface of inorganic substance. Japanese Patent Provisional Publication No. 2(1990)-298939 discloses dyes adsorbed on a polymer. Japanese Patent Provisional Publications No. 56(1981)-12639, No. 55(1980)-155350, No. 55(1980)-155351, No. 63(1988)-27838, No. 63(1988)-197943, No. 2(1990)-264936, European Patents No. 15,601, No. 274,723, No. 276,566, No. 299,435 and WO 88/04794 disclose water-insoluble solid dyes. The solid dyes are particularly preferred.

An image forming method for a lithographic plate is described bellow.

A printed negative original film having an image (e.g., test chart) is laminated on the photographic material of the present invention. The emulsion layers are contact with each other. The lamination is then exposed to light. The exposure may be conducted in a conventional machine (for example, P-627FM, Dainippon Screen Co., Ltd.). Further, a laser plotter (for example, Raster Graph RG-5000, Dainippon Screen Co., Ltd.) and a scanner (for example, Direct Scanner Graph SG-757, Dainippon Screen Co., Ltd. or Lux Scan 4500, Fuji Photo Film Co., Ltd.) can be used to expose the photographic material directly. The direct exposing method is particularly preferred.

After the exposure, the photographic material is developed according to a conventional process. The development can be conducted in an automatic developing machine (for example, FG-680AG, Fuji Photo Film Co., Ltd.)

The exposed and developed photographic material of the present invention is then laminated on a negative or positive presensitized lithographic plate. The presensitized lithographic plate is described in Japanese Patent Provisional Publication No. 3(1991)-273250. The lamination is then exposed to ultraviolet using a mercury lump or a metal halide lamp (e.g., PS light, Fuji Photo Film Co., ltd.). The plate is then developed and rinsed according to a conventional process to obtain a lithographic plate.

The measuring methods used in the example are explained below.

(1) Ultraviolet transmittance

The transmittance of the sample film was measured using an ultraviolet to visible light spectrophotometer at 350 nm using the air as the reference.

The transmittance of a support having a thickness other than 100 μm was calculated according to the following formula.

$$(\log T_x)=(\log T_{100})\times(x/100)$$

wherein $T_x$ is the transmittance (%) of the support having the thickness of x μm, and $T_{100}$ is the transmittance (%) of the support having the thickness of 100 μm (2) The volume ratio of the spherulites A biaxially stretched and thermally fixed support was observed by a polarizing microscope (×400). A photograph was then taken, and magnified (×1,000). The spherulites having a diameter in the range of 0.05 to 5 μm were selected from the photograph. The volume ratio was calculated by dividing the total sectioned area by the split field in the eye piece. The volume ratio was expressed as percentage.

(3) Expansion coefficient to humidity

The average dimensional change of the support at 25° C. between 20% RH and 80% RH was measured immediately after the preparation of the film in the following manner.

(a) The sample was cut into pieces of 5 cm width and 25 cm length.

(b) The sample pieces were conditioned at the humidity for 3 hours, and the dimensional change was measured using a pin gauge having the base length of 20 cm.

The values were measured along the length direction and the width direction. Then the average value was calculated.

(4) The glass transition point (Tg), the crystallization point (Tc) and the melting point (Tm)

These temperatures were measuredly a differential thermal analysis (DSC) according to the following manner.

(a) The sample (10 g) was heated to 330° C. at the rate of 20° C. per minute under nitrogen atmosphere.

(b) The sample was immediatedly cooled to the room temperature, and was heated at the rate of 20° C. per minute.

Tg was evaluated as the average of the temperature at which the shape of the base line was changed and the temperature at which a new base line was formed.

Tc was the temperature showing the maximum peak of the exotherm. The temperature was higher than Tg.

Tm was the temperature showing the maximum peak of the endotherm. The temperature was higher than Tc.

(5) The relative exposure of the photographic material (a) A wedge film (having a continuous gradation of density) was formed from the sample photographic material.

(b) A contact film (Fuji Lith Contact Film VU-S100) was set while placing the light-sensitive layer upward.

(c) The wedge film (a) was set while placing the light-sensitive layer downward to form a lamination.

(d) The lamination was exposed to light using a printer (P627FM type, Dainippon Screen Co., Ltd.).

(e) The contact film was developed under the following conditions.

Automatic developing machine: FG-680AG (Fuji Photo Film Co., Ltd.)

Developing solution: GR-D1 (Fuji Photo Film Co., Ltd.)

Developing temperature: 38° C.

Developing time: 20 seconds

Fixing solution: GR-F1 (Fuji Photo Film Co., Ltd.)

Drying temperature: 50° C.

(f) The exposure required for obtaining the density of 3.0 was measured. The relative exposure $(E/E_0)\times100$ was determined from the exposure using the wedge of the sample photographic material (E) and the exposure using the wedge of the standard PET photographic material ($E_0$).

(6) Handling of the photographic material (occurrence of knick)

After coating the silver halide emulsion layer, a sample sheet A4 size were moved by hands to a table at a distance of 50 cm in a darkroom. The procedure was repeated to move 100 sheets. The samples were developed. A fog of a half circle shape caused by knick was observed. The samples having no fog was evaluated as A, and the samples showing a fog was graded as B.

(7) Sensitivity while printing a presensitized lithographic plate

A gray scale having the density difference of 0.15 was printed on an original film (sample film). The original film was placed on a presensitized lithographic plate (disclosed in Example 1 of Japanese Patent Provisional Publication No. 3(1995)-273250). The lamination was exposed to light using a metal halide lump (MU200-2-OL type, 3 kL, Toshiba Co., Ltd.). The plated was developed, and rinsed. The time required for changing the fifth grade of the gray scale to white was determined. The developing solution was preparedly diluting DP-4 (Fuji Photo Film Co., Ltd.) to ⅛.

(8) The temperature of the raw film from extrusion to stretching

The distance from the casting outlet to the first stretching zone was measured, and divided into 10 parts. The temperatures of the both surfaces of the support at the center along the width direction were measured by a contact thermometer at each of the parts. The highest temperature was then determined.

EXAMPLE 1

(1) Synthesis of plastic polymer

In a reaction vessel, 6 liter of toluene (solvent), 5 mmol of tetraethoxytitanium and 500 mmol (in terms of aluminum) of methylaluminoxane were placed. Further, 48.94 mol of styrene and 1.06 mol of p-methylstyrene were added to the mixture at 50° C. The polymerization reaction proceeded for 2 hours.

After the reaction, the product was washed with a mixture of hydrochloric acid and ethanol to decompose and remove the catalyst. The product was dried to obtain 640 g of a copolymer. The weight average molecular weight (Mw) of the copolymer was 440,000, and the number average molecular weight (Mn) was 240,000. The copolymer was analyzed by $^{13}$C-NMR. As a result, absorption peaks were observed at 145.00, 145.22 and 142.09 ppm. The ratio of the racemic pentad of the styrene units as tacticity was 75%, which was calculated from the peak areas.

The polymerization reactions were repeated in the same manner as is mentioned above, except that the molar ratio of styrene to p-methylstyrene was changed to 50/0, 47.88/2.12 or 46.82/3.18 to form a syndiotactic polymer (p-methyl styrene content: 0 wt. %) or copolymers (p-methyl styrene content: 10 or 15 wt. %). The Mw of the polymers were 400,000, 420,000 and 430,000 respectively. The Mn of the polymers were 220,000, 230,000 and 240,000 respectively. The tacticities of the polymers were 74%, 71% and 70% respectively.

Further, an isotactic polystyrene (HH-30E, Idemitsu Petrochemical Co., Ltd.) was used in a comparative sample.

(2) Formation of the support (2-1) Extrusion to formation of raw film

The above-prepared homopolymer and copolymers were dried for a whole day and night at 150° C. under reduced pressure. Pellets were formed by a single screw extruder. In the case that a polymer mixture was formed, a double screw extruder having a vent was used in place of the single extruder. The pellets were dried for a whole day and night at 130° C. Tg and Tm of the pellets were measured according to the above-mentioned method (4).

The pellets were placed in an extruding machine having a filter and T-die, and then extruded.

The residence time between the hopper and the T-die was determined from the average extruded amount. The results are set forth in Table 1.

The extruding temperature was the average temperature measured at the outlet of the extruding machine.

The melt extruded from the T-die was hardened on a cooling roll of the casting drum to form a raw sheet.

The time between the outlet of T-die and the cooling roll was determined from the linear flow rate of the melt and the distance between the T-die and the casting drum. The flow rate was calculated from the extruded amount and the thickness and the width of the extruded and hardened raw sheet. The time was changed by adjusting the distance between the T-die and the casting drum.

The casting drum was made of a hollow stainless roll. The temperature set forth in Table 1 was kept by using circulating water adjusted at a constant temperature.

Further, a static charge was applied at the casting stage to keep the flatness.

The thickness of the raw sheet was adjusted by controlling the distance between the T-die and the casting drum. The extruding conditions are set forth in Table 1.

The raw sheet was peeled out from the casting drum. The sheet was then conveyed on rolls having the diameter set forth in Table 1 to a longitudinal stretching zone. At the conveying stage, 6 stainless rolls were arranged alternatively. The distance between each two rolls was 300 mm. The wrap angle was 150°. The temperature of the support was controlled by the air adjusted at a constant temperature. The temperature of the support was measured a contact thermometer as is described in (8). The surface of the support was observed with naked eyes, and the occurrences of marks (hexagonal pattern of 1 mm to 10 cm) were evaluated. The results are set forth in Table 1.

TABLE 1

| | | Tg | Tm | Extruding Conditions | |
|---|---|---|---|---|---|
| No. | Polymer | (°C.) | (°C.) | Time* | Temperature |
| 1-1 | CP-3 | 97 | 250 | 14 | 340° C. |
| 1-2 | CP-3 | 97 | 250 | 4 | 340° C. |
| 1-3 | CP-3 | 97 | 250 | 6 | 340° C. |
| 1-4 | CP-3 | 97 | 250 | 14 | 340° C. |
| 1-5 | CP-3 | 97 | 250 | 14 | 340° C. |
| 1-6 | CP-3 | 97 | 250 | 14 | 270° C. |
| 1-7 | CP-3 | 97 | 250 | 14 | 290° C. |
| 1-8 | CP-3 | 97 | 250 | 14 | 380° C. |
| 1-9 | CP-3 | 97 | 250 | 14 | 360° C. |
| 1-10 | CP-3 | 97 | 250 | 14 | 340° C. |
| 1-11 | CP-3 | 97 | 250 | 14 | 340° C. |
| 1-12 | CP-17 | 95 | 248 | 14 | 340° C. |
| 1-13 | CP-5 | 100 | 257 | 14 | 340° C. |
| 1-14 | HP-1 | 95 | 247 | 14 | 350° C. |
| 1-15 | PM-1 | 99 | 248 | 14 | 340° C. |
| 1-16 | PM-17 | 97 | 250 | 14 | 340° C. |
| 1-17 | CP-3 | 97 | 250 | 14 | 340° C. |
| 1-18 | CP-3 | 97 | 250 | 14 | 340° C. |
| 1-19 | CP-3 | 97 | 250 | 14 | 340° C. |
| 1-20 | PET | — | — | — | — |
| 1-21 | PET | — | — | — | — |
| 1-22 | CP-3 | 97 | 250 | 14 | 310° C. |
| 1-23 | CP-3 | 97 | 250 | 14 | 310° C. |
| 1-24 | CP-3 | 97 | 250 | 14 | 310° C. |
| 1-25 | CP-3 | 97 | 250 | 14 | 310° C. |
| 1-26 | CP-3 | 97 | 250 | 14 | 310° C. |
| 1-27 | CP-3 | 97 | 250 | 14 | 310° C. |
| 1-28 | CP-3 | 97 | 250 | 14 | 310° C. |
| 1-29 | CP-3 | 97 | 250 | 14 | 310° C. |

| | Casting Conditions | | Conveying conditions | | |
|---|---|---|---|---|---|
| No. | Time** | Temperature | Roll | Temperature | Mark |
| 1-1 | 0.3 | 40° C. | 150 | 65° C. | None |
| 1-2 | 0.3 | 40° C. | 150 | 65° C. | None |
| 1-3 | 2.2 | 40° C. | 150 | 65° C. | None |
| 1-4 | 1.8 | 40° C. | 150 | 65° C. | None |
| 1-5 | 0.3 | 40° C. | 150 | 65° C. | None |
| 1-6 | 0.3 | 40° C. | 150 | 65° C. | None |
| 1-7 | 0.3 | 40° C. | 150 | 65° C. | None |
| 1-8 | 0.3 | 40° C. | 150 | 65° C. | None |
| 1-9 | 0.3 | 40° C. | 150 | 65° C. | None |
| 1-10 | 0.3 | 80° C. | 150 | 65° C. | None |
| 1-11 | 0.3 | 75° C. | 150 | 65° C. | None |
| 1-12 | 0.3 | 40° C. | 150 | 65° C. | None |
| 1-13 | 0.3 | 40° C. | 150 | 65° C. | None |
| 1-14 | 0.3 | 40° C. | 150 | 65° C. | None |
| 1-15 | 0.3 | 40° C. | 150 | 65° C. | None |
| 1-16 | 0.3 | 40° C. | 150 | 65° C. | None |
| 1-17 | 0.3 | 40° C. | 150 | 65° C. | None |
| 1-18 | 0.3 | 40° C. | 150 | 65° C. | None |
| 1-19 | 0.3 | 40° C. | 150 | 65° C. | None |
| 1-20 | — | — | — | — | — |
| 1-21 | — | — | — | — | — |
| 1-22 | 0.3 | 60° C. | 150 | 65° C. | None |
| 1-23 | 0.3 | 60° C. | 60 | 65° C. | None |
| 1-24 | 0.3 | 60° C. | 40 | 65° C. | None |
| 1-25 | 0.3 | 60° C. | 150 | 125° C. | Observed |
| 1-26 | 0.3 | 60° C. | 150 | 110° C. | None |
| 1-27 | 0.3 | 60° C. | 150 | 35° C. | None |
| 1-28 | 0.3 | 60° C. | 150 | 25° C. | None |
| 1-29 | 0.3 | 60° C. | 150 | 65° C. | None |

Remark:
(CP-3) Styrene/p-methylstyrene syn-copolymer (95/5)
(CP-17) Styrene/p-methylstyrene syn-copolymer (90/10)
(CP-5) Styrene/p-methylstyrene syn-copolymer (85/15)
(HP-1) Syndiotactic polystyrene
(PM-1) Syn-polystyrene + syn-poly-p-methylstyrene (95 + 5)
(PM-17) Syn-polystyrene + atc-polystyrene (95 + 5)
(PET) Polyethylene terephthalate
(Time*) The residence time (minutes) in the extruding machine
(Time**) The time between the T-die and the casting drum
(Roll) The diameter of the smallest roll (mm)
(Mark) Marks formed by rollers (2-2) Formation of stretched film The raw sheet was stretched at Tg+15° C. along the longitudinal direction between rolls. The stretching rate was 3,000% per minute. As a result, the length was extended 3.5 times. The sheet was then stretched at Tg+20° C. along the lateral direction using a tenter. The stretching rate was 3,000% per minute. As a result, the length was extended 4.0 times.

The obtained biaxially stretched film was subjected to a heat setting at 250° C. for 30 seconds while conducting a thermal relaxation of 5%.

(2-3) Preparation of PET film

A biaxially stretched polyethylene terephthalate film was prepared according to a conventional process. The thickness of the film was 100 μm or 175 μm.

(2-4) Evaluation of support

After the thermal fixing, the thickness of the film, the ultraviolet transmittance and the expansion coefficient to humidity were measured according to the methods (1) and (3). The results are set forth in Table 2.

(3) Surface treatment of the support

The both surfaces of the support were subjected to a glow charge treatment in the following manner.

Four cylindrical rods (electrodes) were fixed on an insulated board at the distance of 10 cm. The rod had the sectioned diameter of 2 cm and the length of 150 cm. A cooling medium flowed in the hollow of the rod. The electrode board was fixed in a vacuum tank. A biaxially stretched film was moved parallel to the electrode face at the distance of 15 cm. The moving speed was controlled to subject the surface to the treatment for 2 seconds.

The film is conveyed on a heated roll having a thermostat for three quarters round just before the film reaches the electrode. The heated roll has the diameter of 50 cm. Further, a thermocouple thermometer was in contact with the surface of the film between the heated roll and the electrode zone to control the surface temperature at 90° C.

The pressure in the vacuum tank was 0.2 Torr. The partial pressure of $H_2O$ in the atmosphere was 75%. The charge frequency was 30 KHz. The power was 2,500 W. The treatment strength was 0.5 KV·A·minute/$m^2$. After the charge treatment, the support was conveyed on a cooling roll having a thermostat. The diameter of the roll was 50 cm. The support was then wound up.

(4) Preparation of photographic material (4-1) Formation of undercoating layer

The coating solution for an undercoating layer having the following composition was coated on the treated surface of the support using a wire bar in the coated amount of 10 ml/$m^2$. The support was then dried at 115° C. for 2 minutes, and wound up.

| Undercoating layer | |
|---|---|
| Gelatin | 10.0 weight parts |
| Water | 24.0 weight parts |
| Methanol | 961.0 weight parts |
| Salicylic acid | 3.0 weight parts |
| Polyamide-epichlorohydrin resin (described in synthesis example 1 of Japanese Patent Provisional Publication No. 51(1976)-27099) | 0.5 weight part |
| Nonion surface active agent (Compound I-13 described in Japanese Patent Publication No. 3(1991)-27099) | 1.0 weight part |

(4-2) Formation of the photographic layers

On the surface of the support, the first and second emulsion layers and the lower and upper protective layers were simultaneously coated.

First emulsion layer

An aqueous silver nitrate solution and an aqueous sodium chloride solution containing $(NH_4)_2Rh(H_2O)Cl_5$ ($2\times10^{-5}$ mol per 1 mol of silver) were simultaneously added to an aqueous gelatin solution containing 4-hydroxy-6-methyl-1,3,3a,7-tetrazaindene ($5\times10^{-3}$ mol per 1 mol of silver) kept at 40° C. The addition was continued for 7 minutes while controlling the potential of 95 mV. Thus, core grains of 0.12 μm were formed. Further, an aqueous silver nitrate solution and an aqueous sodium chloride solution containing $(NH_4)_2Rh(H_2O)Cl_5$ ($1.2\times10^{-5}$ mol per 1 mol of silver) were simultaneously added to the core grains. The addition was continued for 14 minutes while controlling the potential of 95 mV. Thus, silver chloride cubic emulsion was prepared. The average grain size was 0.15 μm.

To the emulsion, 600 mg/$m^2$ of polyethyl acrylate latex (average particle size: 0.05 μm), a solution of $2.2\times10^{-5}$ mol/$m^2$ of the following hydrazine compound (1) and $2.2\times10^{-5}$ mol/$m^2$ of the following hydrazine compound (2), 30 mg/$m^2$ of 4-hydroxy-6-methyl-1,3,3a,7-tetrazaindene, 40 mg/$m^2$ of the following compound (1), 40 mg/$m^2$ of the following compound (2) and 98 mg/$m^2$ of the following compound (3) (hardening agent) were added to obtain a coating solution. The solution was coated on the undercoating layer. The coated amount of silver was 2.0 g/$m^2$. The coated gelatin amount was 0.9 2.0 g/$m^2$.

Hydrazine compound (1)

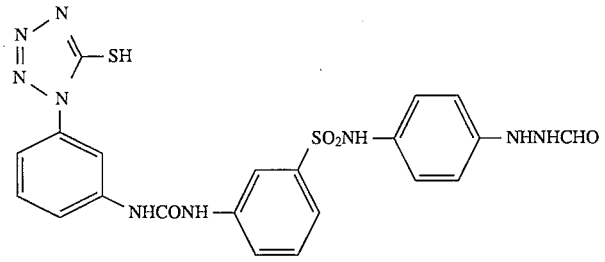

Hydrazine compound (2)

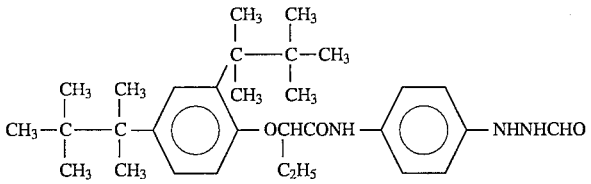

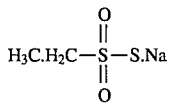

-continued

Compound (1)

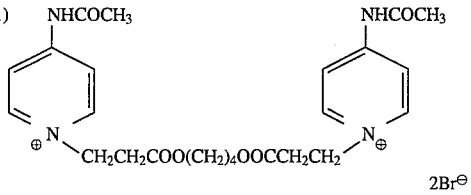

Compound (2)

$CH_2=CHSO_2CH_2SO_2CH=CH_2$ Compound (3)

Second emulsion layer

An aqueous silver nitrate solution and an aqueous sodium chloride solution containing $(NH_4)_2Rh(H_2O)Cl_5$ ($4\times10^{-5}$ mol per 1 mol of silver) were simultaneously added to an aqueous gelatin solution containing 4-hydroxy-6-methyl-1,3,3a,7-tetrazaindene ($5\times10^{-3}$ mol per 1 mol of silver) kept at 40° C. The addition was continued for 3.5 minutes while controlling the potential of 95 mV. Thus, core grains of 0.08 pm were formed. Further, an aqueous silver nitrate solution and an aqueous sodium chloride solution containing $(NH_4)_2Rh(H_2O)Cl_5$ ($1.2\times10^{-5}$ mol per 1 mol of silver) were simultaneously added to the core grains. The addition was continued for 7 minutes while controlling the potential of 95 mV. Thus, silver chloride cubic emulsion was prepared. The average grain size was 0.10 μm.

The coating solution was prepared in the same manner as in the formation of the first emulsion layer, except that the above-prepared emulsion was used. The solution was coated on the first emulsion layer. The coated amount of silver was 1.5 g/m². The coated gelatin amount was 0.7 2.0 g/m².

| Lower protective layer | |
|---|---|
| Gelatin | 0.55 g/m² |
| 1-Hydroxy-2-benzaldoxime | 15 mg/m² |
| Compound (4) | 80 mg/m² |
| Compound (5) | 10 mg/m² |
| Polyethyl acrylate latex (average particle size: 0.05 μm) | 280 mg/m² |
| **Upper protective layer** | |
| Gelatin | 0.95 g/m² |
| Amorphous matting agent ($SiO_2$, average particle size: 3.0 μm) | 30 mg/m² |
| Spherical matting agent (polymethyl methacrylate particles, average particle size: 2.7 μm) | 30 mg/m² |
| Fluid paraffin (gelatin dispersion) | 50 mg/m² |
| Potassium N-perfluorooctanesulfonyl-N-propyl-glycine | 5 mg/m² |
| Sodium dodecylbenzenesulfonate | 10 mg/m² |
| Solid dye dispersion A | 80 mg/m² |
| Solid dye dispersion B | 80 mg/m² |

Preparation of solid dye dispersions A & B

In a bottle of 1.5 liter having a screwed cap, 434 ml of water and 6.7% solution of 53 g of a surface active agent (Triton X-200R, Rohm & Haas) were placed. To the mixture, 20 g of the dye and 800 ml of zirconium dioxide ($ZrO_2$) beads (particle size: 2 mm) were added. The cap was tightly closed. The bottle was placed in a mill to crash the contents for 4 days.

The contents were added to 12.5 5 aqueous gelatin solution (160 g). The mixture was placed in a roll mill for 10 minutes to remove bubbles. The obtained mixture was filtered out to remove $ZrO_2$ beads. The average particle size was about 3.0 μm. However, the mixture contained crude particles. The mixture was then centrifuged to classify the particles so that the maximum particle size in the resulting mixture was 1 μm.

Compound (4)

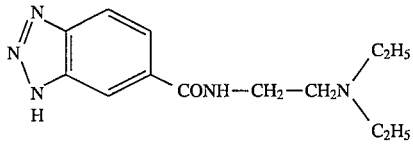

Compound (5)

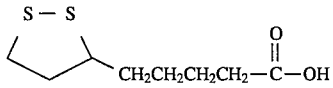

Solid dye A

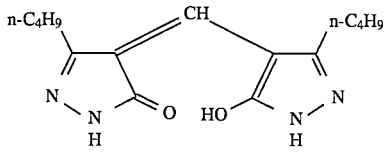

Solid dye B

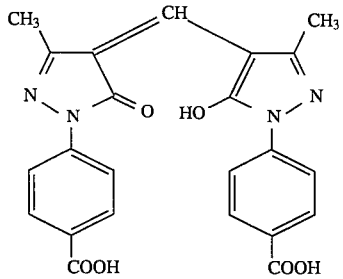

(4-3) Formation of backing layers

On the reverse side of the support, the following electroconductive backing layer and the surface backing layer were simultaneously coated.

| Electroconductive backing layer | |
|---|---|
| $SnO_2$/Sb (weight ratio: 9/1, average particle size: 0.25 μm) | 200 mg/m² |
| Gelatin ($Ca^{2+}$ content: 3,000 ppm) | 77 mg/m² |
| Compound (6) | 7 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |
| **Surface backing layer** | |
| Gelatin ($Ca^{2+}$ content: 30 ppm) | 2.82 g/m² |
| Polymethyl methacrylate particles (average particle size: 4.7 μm) | 54 mg/m² |
| Compound (6) | 3 mg/m² |
| Compound (7) | 40 mg/m² |
| Compound (8) | 40 mg/m² |
| Compound (9) | 80 mg/m² |
| Compound (10) | 150 mg/m² |
| Sodium dodecylbenzenesulfonate | 75 mg/m² |
| Sodium dihexyl-α-sulfosuccinate | 20 mg/m² |
| Compound (11) | 5 mg/m² |

-continued

| | |
|---|---|
| Sodium sulfate | 50 mg/m$^2$ |
| Sodium acetate | 85 mg/m$^2$ |
| 1,2-Bis(vinylsulfonylacetamide)ethane | 150 mg/m$^2$ |

Compound (6)

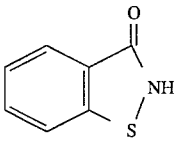

Compound (7)

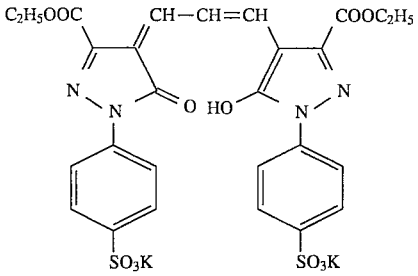

Compound (8)

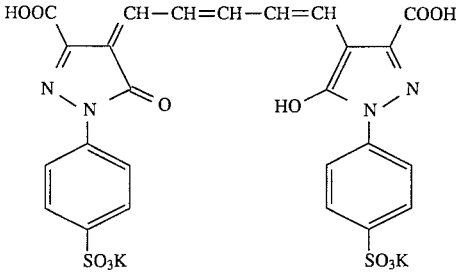

Compound (9)

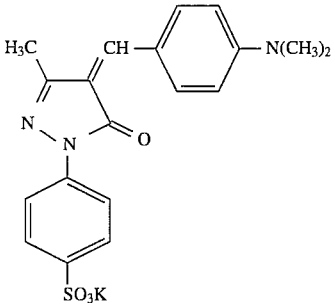

Compound (10)

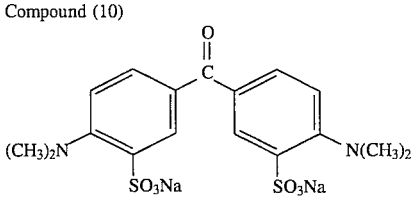

Compound (11)
$C_8F_{17}SO_3Li$ (4-4) Evaluation of the photographic material

The prepared photographic material was evaluated with respect to the relative exposure and the handling according to the previously described methods. The results are set forth in Table 2.

TABLE 2

| | Support | | | Photographic material | |
|---|---|---|---|---|---|
| No. | Thickness | Transmit. | Stability | Exposure | Handling |
| 1-1 | 100 μm | 82% | $1.2 \times 10^{-6}$ | 85% | A |
| 1-2 | 100 μm | 68% | $1.1 \times 10^{-6}$ | 99% | A |
| 1-3 | 100 μm | 72% | $1.2 \times 10^{-6}$ | 95% | A |
| 1-4 | 100 μm | 68% | $1.2 \times 10^{-6}$ | 100% | A |
| 1-5 | 100 μm | 72% | $1.3 \times 10^{-6}$ | 95% | A |
| 1-6 | 100 μm | 69% | $1.3 \times 10^{-6}$ | 99% | A |
| 1-7 | 100 μm | 72% | $1.3 \times 10^{-6}$ | 95% | A |
| 1-8 | 100 μm | 68% | $1.2 \times 10^{-6}$ | 100% | A |
| 1-9 | 100 μm | 71% | $1.2 \times 10^{-6}$ | 95% | A |
| 1-10 | 100 μm | 68% | $1.3 \times 10^{-6}$ | 88% | A |
| 1-11 | 100 μm | 72% | $1.2 \times 10^{-6}$ | 90% | A |
| 1-12 | 100 μm | 81% | $1.4 \times 10^{-6}$ | 86% | A |
| 1-13 | 100 μm | 82% | $1.5 \times 10^{-6}$ | 84% | A |
| 1-14 | 100 μm | 76% | $1.1 \times 10^{-6}$ | 90% | A |
| 1-15 | 100 μm | 80% | $1.2 \times 10^{-6}$ | 87% | A |
| 1-16 | 100 μm | 78% | $1.3 \times 10^{-6}$ | 90% | A |
| 1-17 | 88 μm | 83% | $1.4 \times 10^{-6}$ | 85% | B |
| 1-18 | 92 μm | 83% | $1.4 \times 10^{-6}$ | 85% | A |
| 1-19 | 175 μm | 83% | $1.1 \times 10^{-6}$ | 86% | A |
| 1-20 | 100 μm | 68% | $8.7 \times 10^{-6}$ | 100% | A |
| 1-21 | 175 μm | 68% | $8.6 \times 10^{-6}$ | 100% | A |
| 1-22 | 100 μm | 82% | $1.3 \times 10^{-6}$ | 85% | A |
| 1-23 | 100 μm | 71% | $1.2 \times 10^{-6}$ | 95% | A |
| 1-24 | 100 μm | 69% | $1.5 \times 10^{-6}$ | 98% | A |
| 1-25 | 100 μm | 73% | $1.3 \times 10^{-6}$ | 95% | A |
| 1-26 | 100 μm | 82% | $1.4 \times 10^{-6}$ | 84% | A |
| 1-27 | 100 μm | 72% | $1.3 \times 10^{-6}$ | 94% | A |
| 1-28 | 100 μm | 68% | $1.5 \times 10^{-6}$ | 98% | A |
| 1-29 | 175 μm | 82% | $1.2 \times 10^{-6}$ | 85% | A |

Remark:
(Transmit.) Ultraviolet transmittance at 350 nm (the thickness of the support: 100 μm)
(Stability) Expansion coefficient to humidity (% RH)
(Exposure) Relative exposure
(Handling) Occurrence of knick It is apparent form the results shown in Table 2 that the supports of the present invention (Sample Nos. 1-1, 3, 5, 7, 9, 11 to 19, 22, 23, 25-27 and 29) are superior to the PET supports (Sample Nos. 1-20 and 21) with respect to the ultraviolet transmittance. The photographic material using the supports of the invention show small relative exposures. Therefore, the sensitivity at the contact exposure is increased. The excellent characteristics of the present invention were obtained by adjusting the conditions in preparation of the support.

The characteristics of the supports were also obtained by using a copolymer (Sample Nos. 1-1 to 13), a homopolymer (Sample No. 1-14) or a polymer mixture (Sample Nos. 1-15 and 16).

On the other hand, the samples Nos. 1-2, 1-4, 1-6, 1-8 and 1-10 were scarcely improved in the ultraviolet transmittance and the relative exposure, compared with the PET supports.

The thickness of the support is preferably not less than 90 μm because a thin support causes knick while handling the photographic material (Sample No. 1-17).

Further, the occurrence of crazing can be inhibited by conveying the support between the casting drum and the stretching zone under the conditions of the present invention. The support having no crazing has a high transmittance of ultraviolet. If a small roll is used to convey the support (Sample No. 1-23), the ultraviolet transmittance is decreased. Further, a high temperature of the conveying roll causes a mark of the roll on the sheet (Sample No. 1-25). On the other hand, a low temperature of the conveying roll reduces the ultraviolet transmittance (Sample No. 1-28).

EXAMPLE 2

[Preparation of Sample Nos. 2-1 to 2-5]

(1) Support

The support of the sample No. 1-19 (syndiotactic polystyrene support) was subjected to a surface treatment (glow discharge treatment) in the same manner as in Example 1. Further, an undercoating layer was coated on the support in the same manner as in Example 1.

(2) Formation of backing layers

The following electroconductive backing layer and a hydrophilic colloidal surface backing layer were coated on a side of the support using a slide coater.

| Electroconductive backing layer | |
|---|---|
| Gelatin ($Ca^{2+}$ content: 3,000 ppm) | 100 mg/m$^2$ |
| Compound A | 1 mg/m$^2$ |
| Sodium dihexyl-α-sulfosuccinate | 11 mg/m$^2$ |
| Sodium dodecylbenzenesulfonate | 15 mg/m$^2$ |
| Sodium polystyrenesulfonate | 10 mg/m$^2$ |
| $SnO_2$/Sb (weight ratio: 9/1, average particle size: 0.25 μm) | 200 mg/m$^2$ |
| **Surface backing layer** | |
| Gelatin ($Ca^{2+}$ content: 30 ppm) (Amount is set forth in Table 3) | |
| Polymethyl methacrylate particles (average particle size: 3.4 μm) | 20 mg/m$^2$ |
| Compound A | 4 mg/m$^2$ |
| Dye (1) | 60 mg/m$^2$ |
| Dye (2) | 40 mg/m$^2$ |
| Dye (3) | 32 mg/m$^2$ |
| Sodium dihexyl-α-sulfosuccinate | 20 mg/m$^2$ |
| Sodium dodecylbenzenesulfonate | 80 mg/m$^2$ |
| Acetic acid | 7 mg/m$^2$ |
| Sodium sulfate | 200 mg/m$^2$ |
| Compound C | 8 mg/m$^2$ |
| Compound D | 9 mg/m$^2$ |
| Sodium polystyrenesulfonate | 16 mg/m$^2$ |
| 1,3-Bis(vinylsulfonyl)propanol-2 | 1.8 wt. % of gelatin |

Compound A

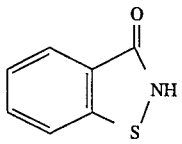

Dye (1)

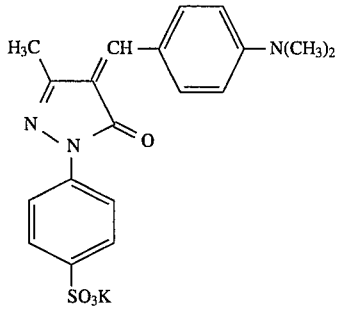

Dye (2)

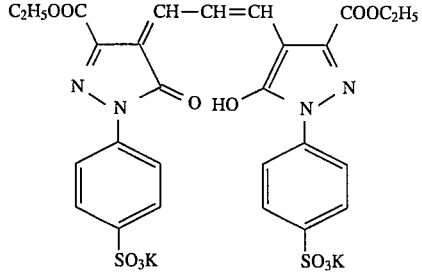

-continued

Dye (3)

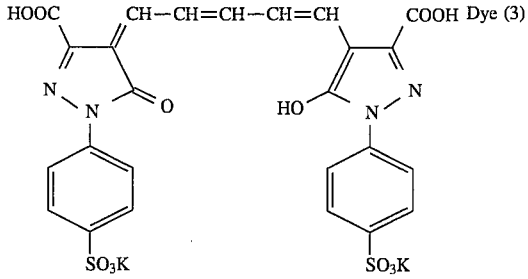

$C_8F_{17}SO_3Li$ Compound C $C_8F_{17}SO_2N(C_3H_7)-CH_2COOK$ Compound D (3) Formation of photographic layers On the reverse side of the support, a non-light-sensitive layer, an emulsion layer and a protective layer were simultaneously coated using a slide coater, and dried.

| (3-1) Non-light-sensitive layer | |
|---|---|
| Gelatin | 1.0 g/m$^2$ |
| Sodium polystyrenesulfonate | 15 mg/m$^2$ |
| 2,4-Dichloro-6-hydroxy-s-triazine | 7 mg/m$^2$ |
| 1,3-Bis(vinylsulfonyl)propanol-2 | 15 mg/m$^2$ |
| Polyethyl acrylate latex (particle size: 0.05 μm) | 600 mg/m$^2$ |

(3-2) Emulsion layer

A silver halide emulsion was prepared according to a conventional process. The silver bromide content in the emulsion was 30 mol %, and the silver chloride content was 70 mol %. The emulsion further contain $3.5\times10^{-7}$ (based on 1 mol of silver) of rhodium. After soluble salts were removed form the emulsion, gelatin was added to the emulsion. To the emulsion, 6 mg of sodium thiosulfate, 8.5 mg of chloroauric acid were added based on 1 mol of silver. The emulsion was then subjected to a chemical sensitization at 60 ° C. for 50 minutes.

The average grain size of the obtained emulsion was 0.25 μm. The grain shape was cubic. The silver content and the gelatin content were 125 g and 53 g respectively based on 1 kg of the emulsion.

To the emulsion, 11 mg of potassium 1-(2-hydroxyethoxyethyl)-3-(pyridine-2-yl)-5-[(3-sulfobutyl-5-chloro-2-benzoxiazolinidene)ethylidene]-2-thiohydantoin was added as an ortho dye. Further, 7 mg/m$^2$ of ribonucleic acid, 27 mg/m$^2$ of hydroquinone, 3 mg/m$^2$ of the compound (1), 1 mg/m$^2$ of 1-phenyl-5-mercapto-tetrazole, 1 mg/m$^2$ of the compound (2), 6 mg/m$^2$ of the compound (3), 4 mg/m$^2$ of the compound (4), 2 mg/m$^2$ of the compound (5), 8 mg/m$^2$ of 6-methyl-4-hydroxy-1,3,3a,7-tetrazaindene (stabilizer) and 40 mg/m$^2$ of 1,3-bis(vinylsulfonyl)propanol-2 were added to the emulsion. Furthermore, 900 mg/m$^2$ of ethyl acrylate latex (average particle size: 0.05 μm) and 40 mg/m$^2$ of sodium polystyrenesulfonate were added to the emulsion to prepare a coating solution.

The coating amount of silver was 3.5 g/m$^2$ and the coating amount of gelatin was 1.6 mg/m$^2$.

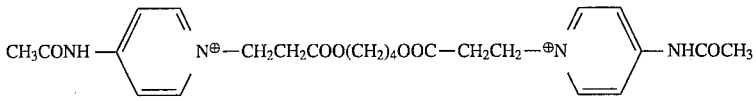

Compound (1)

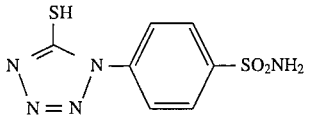

Compound (2)

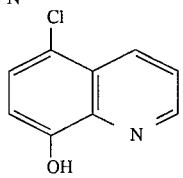

Compound (3)

$HO_9CH_2CH_2O)_a(CH_2CH_2CH_2CH_2O)_b(CH_2CH_2O)_cH$ Compound (4)
$a+c=30$, $b=14$

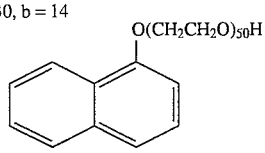

Compound (5)

[Preparation of Sample Nos. 2-6 and 2-7]

(1) Support

The support of the sample No. 1-19 (syndiotactic polystyrene support) was subjected to a surface treatment (glow discharge treatment) in the same manner as in Example 1. Further, an undercoating layer was coated on the support in the same manner as in Example 1.

(2) Formation of backing layers

The following electroconductive backing layer was coated on a side of the support, and dried for 3 minutes. Further the following hydrophilic colloidal surface backing layer were coated on the electroconductive backing layer, and dried for 3 minutes.

| Electroconductive backing layer (Sample No. 6) | |
|---|---|
| Methyl methacrylate/ethyl acrylate/acrylic acid copolymer (60/35/5) latex (average particle size: 0.1 μm) | 100 mg/m$^2$ |
| Sodium dodecylbenzenesulfonate | 15 mg/m$^2$ |
| $SnO_2$/Sb (weight ratio: 9/1, average particle size: 0.25 μm) | 200 mg/m$^2$ |
| Drying temperature | 110° C. |
| **Electroconductive backing layer (Sample No. 7)** | |
| Vinylidene chloride (molecular weight: 100,000) | 100 mg/m$^2$ |
| $SnO_2$/Sb (weight ratio: 9/1, average particle size: 0.25 μm) | 200 mg/m$^2$ |
| (Tetrahydrofuran solution) | |
| Drying temperature | 80° C. |
| **Surface backing layer (Sample No. 6)** | |
| Polyolefin latex (Chemipal S-120, Mitsui Petrochemical Co., Ltd.) | 1 g/m$^2$ |
| Polymethyl methacrylate particles (average particle size: 3.4 μm) | 20 mg/m$^2$ |
| Sodium dodecylbenzenesulfonate | 80 mg/m$^2$ |
| $C_8F_{17}SO_3Li$ | 8 mg/m$^2$ |
| $C_8F_{17}SO_2N(C_3H_7)CH_2COOK$ | 9 mg/m$^2$ |
| Drying temperature | 110° C. |
| **Surface backing layer (Sample No. 7)** | |
| Polymethyl methacrylate (molecular weight: 100,000) | 1 g/m$^2$ |
| Cross-linked polymethyl methacrylate particles (average particle size: 3.4 μm) | 20 mg/m$^2$ |
| $C_8F_{17}SO_3Li$ | 8 mg/m$^2$ |
| $C_8F_{17}SO_2N(C_3H_7)CH_2COOK$ | 9 mg/m$^2$ |

-continued

| | |
|---|---|
| (Ethyl acetate solution) | |
| Drying temperature | 80° C. |

(3) Formation of photographic layers

On the reverse side of the support, a non-light-sensitive layer, an emulsion layer and a protective layer were simultaneously coated using a slide coater.

| (3-1) Non-light-sensitive layer | |
|---|---|
| Gelatin | 1.0 g/m$^2$ |
| Compound A | 2 mg/m$^2$ |
| Solid dye dispersion A | 70 mg/m$^2$ |
| Solid dye dispersion B | 75 mg/m$^2$ |
| Sodium polystyrenesulfonate | 15 mg/m$^2$ |
| 2,4-Dichloro-6-hydroxy-s-triazine | 7 mg/m$^2$ |
| 1,3-Bis(vinylsulfonyl)propanol-2 | 15 mg/m$^2$ |
| Polyethyl acrylate latex (particle size: 0.05 μm) | 600 mg/m$^2$ |

The solid dye dispersions were prepared in the same manner as in Example 1, except that the following dyes A & B were used.

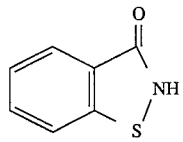

Compound A

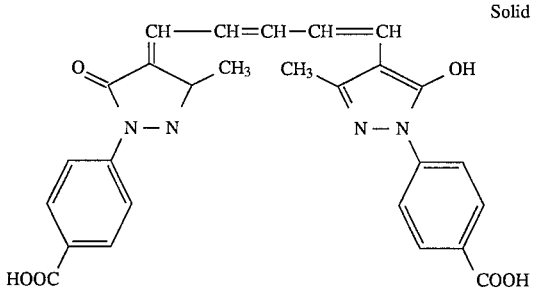

Solid dye A

-continued

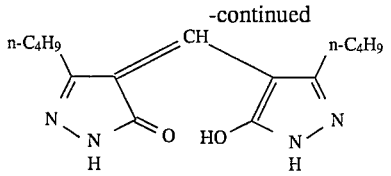

Solid dye B (3-2) Emulsion layer and protective layer

The emulsion layer and the protective layer were formed in the same manner as in the preparation of the sample Nos. 1 to 5.

[Preparation of Sample Nos. 2-8 to 2-14]

(1) Support

The biaxially stretched support of the sample No. 1-21 (syndiotactic polystyrene support) having the thickness of 175 μm was subjected to a surface treatment (glow discharge treatment) in the same manner as in Example 1. Further, an undercoating layer was coated on the support in the same manner as in Example 1.

Furthermore, the backing layers and the photographic layers were coated on the support in the same manner as in the preparations of the sample Nos. 1 to 7 to prepare samples No. 8 to 14 respectively. The prepared samples are set forth in Table 3.

TABLE 3

| | | Photo. layers | | | | Backing layers | | | |
|---|---|---|---|---|---|---|---|---|---|
| No. | Support | (1) | (2) | (3) | Total | (4) | (5) | Total | Ratio |
| 2-1 | 1-19 | 1.5 | 1.6 | 1.0 | 3.6 | 0.1 | 3.5 | 3.6 | 1.00 |
| 2-2 | 1-19 | 1.5 | 1.6 | 1.0 | 3.6 | 0.1 | 2.6 | 2.7 | 0.75 |
| 2-3 | 1-19 | 1.5 | 1.6 | 1.0 | 3.6 | 0.1 | 1.7 | 1.8 | 0.50 |
| 2-4 | 1-19 | 1.5 | 1.6 | 1.0 | 3.6 | 0.1 | 1.4 | 1.5 | 0.42 |
| 2-5 | 1-19 | 1.5 | 1.6 | 1.0 | 3.6 | 0.1 | 1.1 | 1.2 | 0.33 |
| 2-6 | 1-19 | 1.5 | 1.6 | 1.0 | 3.6 | 0.1 | 0 | 0 | 0.00 |
| 2-7 | 1-19 | 1.5 | 1.6 | 1.0 | 3.6 | 0.1 | 0 | 0 | 0.00 |
| 2-8 | 1-21 | 1.5 | 1.6 | 1.0 | 3.6 | 0.1 | 3.5 | 3.6 | 0.75 |
| 2-9 | 1-21 | 1.5 | 1.6 | 1.0 | 3.6 | 0.1 | 2.6 | 2.7 | 0.50 |
| 2-10 | 1-21 | 1.5 | 1.6 | 1.0 | 3.6 | 0.1 | 1.7 | 1.8 | 0.42 |
| 2-11 | 1-21 | 1.5 | 1.6 | 1.0 | 3.6 | 0.1 | 1.4 | 1.5 | 0.33 |
| 2-12 | 1-21 | 1.5 | 1.6 | 1.0 | 3.6 | 0.1 | 1.1 | 1.2 | 1.00 |
| 2-13 | 1-21 | 1.5 | 1.6 | 1.0 | 3.6 | 0.1 | 0 | 0 | 0.00 |
| 2-14 | 1-21 | 1.5 | 1.6 | 1.0 | 3.6 | 0.1 | 0 | 0 | 0.00 |

Remark:
(Photo. layers) The amount of gelatin contained in the photographic layers ($g/m^2$)
(1) Non-light-sensitive layer
(2) Emulsion layer
(3) Protective layer
(Backing layers) The amount of gelatin contained in the backing layers ($g/m^2$)
(4) Electroconductive backing layer
(5) Surface backing layer
(Ratio) The ratio of the amount of gelatin contained in the backing layers to that contained in the photographic layers

[Evaluation of samples]

The obtained photographic materials were stored at 25° C. and 65% RH for 10 days. The materials were evaluated in the following manner.

(1) Relative exposure

A photographic material of a PET support having the same photographic and backing layers was compared with the material of the syndiotactic styrenic polymer (styrene/-p-methyl styrene copolymer) support in the same manner as in Example 1 to determine the relative exposure.

(2) Dimensional stability

The samples were cut into pieces of 5 cm×25 cm. Two holes having the diameter of 8 mm were opened at the distance of 200 mm in the samples. The samples were conditioned at 25° C. and 55% RH for 24 hours.

The distance between the two holes was measured using a pin gage at the precision of 1/1000 mm. The measured distance is X mm.

The sample was then conditioned at 25° C. and 30% RH for 24 hours. Then, the distance between the two holes was measure in the same manner. The measured distance is Y mm.

The dimensional change was calculated according to the following formula $$\text{Dimensional change}=(X-Y)/\{200\times(55-30)\}\times 100\ (\%/\%\ \text{RH})$$

The results are set forth in Table 4.

TABLE 4

| No. | Support | Gelatin ratio | Dimensional stability | Relative Exposure |
|---|---|---|---|---|
| 2-1 | 1-19 | 1.00 | $0.81\times10^{-3}$ | 85 |
| 2-2 | 1-19 | 0.75 | $0.77\times10^{-3}$ | 84 |
| 2-3 | 1-19 | 0.50 | $0.73\times10^{-3}$ | 86 |
| 2-4 | 1-19 | 0.42 | $0.70\times10^{-3}$ | 85 |
| 2-5 | 1-19 | 0.33 | $0.71\times10^{-3}$ | 84 |
| 2-6 | 1-19 | 0.00 | $0.67\times10^{-3}$ | 85 |
| 2-7 | 1-19 | 0.00 | $0.68\times10^{-3}$ | 84 |
| 2-8 | 1-21 | 0.75 | $1.42\times10^{-3}$ | 100 |
| 2-9 | 1-21 | 0.50 | $1.37\times10^{-3}$ | 100 |
| 2-10 | 1-21 | 0.42 | $1.32\times10^{-3}$ | 100 |
| 2-11 | 1-21 | 0.33 | $1.30\times10^{-3}$ | 100 |
| 2-12 | 1-21 | 1.00 | $1.29\times10^{-3}$ | 100 |
| 2-13 | 1-21 | 0.00 | $1.22\times10^{-3}$ | 100 |
| 2-14 | 1-21 | 0.00 | $1.22\times10^{-3}$ | 100 |

As is shown in the results of Table 4, the samples 2-1 to 2-7 of the present invention have an excellent relative exposure. The dimensional stability is also improved in the samples of the present invention. The dimensional stability is further improved by adjusting the ratio of gelatin (the gelatin amount in the backing layers to the gelatin amount in the Photographic layers) of not more than 0.5.

Example 3

(1) Support

Sample Nos. 3-1 to 3-4

The support of the sample No. 1-1 (syndiotactic polystyrene support) was subjected to a surface treatment (glow discharge treatment) in the same manner as in Example 1. Further, an undercoating layer was coated on the support in the same manner as in Example 1.

Sample Nos. 3-5.to 3-8

The support of the sample No. 1-20 (PET support) was subjected to a surface treatment (glow discharge treatment) in the same manner as in Example 1. Further, an undercoating layer was coated on the support in the same manner as in Example 1.

(2) Formation of backing layers

The following electroconductive backing layer, a hydrophilic backing layer and a hydrophobic backing layer were coated on a side of the support using a slide coater, and dried for 5 minutes at 40 ° C.

| | |
|---|---|
| (2-1) Electroconductive backing layer | |
| $SnO_2$/Sb (weight ratio: 9/1, average particle size: 0.25 μm) | 200 $mg/m^2$ |
| Gelatin | 170 $mg/m^2$ |
| Sodium dodecylbenzenesulfonate | 10 $mg/m^2$ |
| 1,3-Divinylsulfonyl-2-propanol | 10 $mg/m^2$ |
| Sodium polystyrenesulfonate | 9 $mg/m^2$ |
| (2-2) Hydrophilic backing layer | |
| Gelatin | 3 $g/m^2$ |
| Sodium dodecylbenzenesulfonate | 0.5 $mg/m^2$ |
| Sodium polystyrenesulfonate | 20 $mg/m^2$ |
| N,N'-ethylenebis-(vinylsulfonacetamide) | 200 $mg/m^2$ |

-continued

| | |
|---|---|
| Polyethyl acrylate latex (average particle size: 0.1 μm) | 1 g/m$^2$ |
| (2-3) Hydrophobic backing layer (Nos. 1–3 & 5–7) | |
| Binder set forth in Table 5 | 1 g/m$^2$ |
| Polymethyl methacrylate fine particles (average particle size: 5 μm) | 10 mg/m$^2$ |
| n-$C_{16}H_{32}OSO_3Na$ | 10 mg/m$^2$ |
| Sodium dodecylbenzenesulfonate | 3 mg/m$^2$ |
| $C_8F_{17}SO_3K$ | 3 mg/m$^2$ |
| (2-3) Surface backing layer (Sample Nos. 4 & 8) | |
| Gelatin | 1 g/m$^2$ |
| N,N'-ethylenebis-(vinylsulfonacetamide) | 60 mg/m$^2$ |
| Polymethyl methacrylate fine particles (average particle size: 5 μm) | 10 mg/m$^2$ |
| n-$C_{16}H_{32}OSO_3Na$ | 10 mg/m$^2$ |
| Sodium dodecylbenzenesulfonate | 3 mg/m$^2$ |
| $C_8F_{17}SO_3K$ | 3 mg/m$^2$ |

(3) Formation of photographic layers

A dye layer, a silver halide emulsion layer, a lower protective layer, an upper protective layer are simultaneously coated on the reverse side of the support using a slide coater.

| (3-1) Dye layer | |
|---|---|
| Gelatin | 1.0 g/m$^2$ |
| Solid dye dispersion A | 70 mg/m$^2$ |
| Solid dye dispersion B | 75 mg/m$^2$ |
| Phosphoric acid | 15 mg/m$^2$ |
| Sodium dodecylbenzensulfonate | 15 mg/m$^2$ |
| Sodium polystyrenesulfonate | 25 mg/m$^2$ |
| 1,1'-Bis(vinylsulfonyl)methane | 30 mg/m$^2$ |

The solid dye dispersions were prepared in the same manner as in Example 1, except that the dyes A & B used in Example 2 were used.

| (3-2) Emulsion layer | |
|---|---|
| Solution (I) | |
| Water | 1,000 ml |
| Gelatin | 20 g |
| Sodium chloride | 20 g |
| 1,3-Dimethylimidazolidine-2-thione | 20 mg |
| Sodium benzenesulfonate | 6 mg |
| Solution (II) | |
| Water | 400 ml |
| Silver nitrate | 100 g |
| Solution (III) | |
| Water | 400 ml |
| Sodium chloride | 30.5 g |
| Potassium bromide | 14 g |
| 0.001% Aqueous solution of potassium hexachloroiridium(III) acid | 15 mg |
| 0.001% Aqueous solution of ammonium hexabromoiridium(III) acid | 15 mg |

The solutions (II) and (III) were added to the solution (I) while stirring at 38° C. and pH of 4.5 for 10 minutes to form core grains of 0.16 μm. Further the following solutions (IV) and (V) were added to the core grains for 10 minutes. Furthermore, 0.15 g of potassium iodide was added to form grains.

| Solution (IV) | |
|---|---|
| Water | 400 ml |
| Silver nitrate | 100 g |
| Solution (V) | |
| Water | 400 ml |
| Sodium chloride | 30.5 g |
| Potassium bromide | 14 g |
| $K_4Fe(CN)_6$ | $1 \times 10^{-5}$ mol per 1 mol of silver |

The emulsion was washed with water according to a conventional flocculation method. Further, 40 g of gelatin was added to the emulsion.

The emulsion was adjusted to pH 5.3 and pAg 7.5. To the emulsion, 5.2 mg of sodium thiosulfate, 10.0 mg of chloroauric acid and 2.0 mg of N,N-dimethylselenourea were added. To the emulsion, 8 mg of sodium benzenesulfonate and 2.0 mg of sodium benzenesulfinate were further added. The emulsion was subjected to a chemical sensitization under the optimum conditions to prepare a cubic silver iodochlorobromide emulsion having the average grain size of 0.20 μm. The silver chloride content was 80 mole %.

To the emulsion, $5\times10^{-4}$ mol of the sensitizing dye (1) was added, and the emulsion was subjected to an ortho sensitization. Further, hydroquinone (2.5 g per 1 mol of silver), 1-phenyl-5-mercaptotetrazole (2.5 g per 1 mol of silver), colloidal silica (Snowtechs C, Nissan Chemical Co., Ltd., average particle size: 0.015 μm, 30 wt. % of gelatin), polyethyl acrylate latex of 0.05 μm (plasticizer, 40 wt. % of gelatin) and 1,1'-bis(vinylsulfonyl)methane (hardening agent, 180 mg/m$^2$) were added to the emulsion.

The coating amount of silver was 3.0 g/m$^2$, and the coating amount of gelatin was 1.5 g/m$^2$.

Sensitizing dye (1)

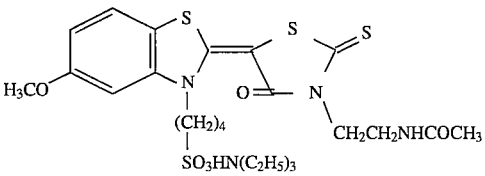

| (3-3) Lower protective layer | |
|---|---|
| Gelatin | 0.25 g/m$^2$ |
| Sodium benzenesulfonate | 4 mg/m$^2$ |
| 1-Hydroxy-2-benzaldoxime | 25 mg/m$^2$ |
| Polyethyl acrylate latex | 125 mg/m$^2$ |
| Upper protective layer | |
| Gelatin | 0.25 g/m$^2$ |
| Silica matting agent (average particle size: 2.5 μm) | 50 mg/m$^2$ |
| Gelatin dispersion of the compound (1) | 30 mg/m$^2$ |
| Colloidal silica (Snowtechs C, Nissan Chemical Co., Ltd.) | 30 mg/m$^2$ |
| Compound (2) | 5 mg/m$^2$ |
| Sodium dodecylbenzenesulfonate | 10 mg/m$^2$ |

Compound (1)

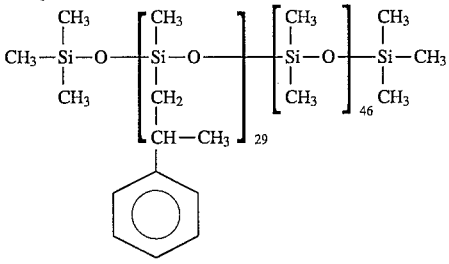

-continued

Compound (2)

$C_8F_{17}SO_2N(C_3H_7)-CH_2COOK$

The obtained samples were stored at 25° C. and 65% RH for 10 days. The samples were evaluatedby the following manner.

(4) Evaluation of samples (4-1) Swelling of backing layers

Dry thickness $d_0$: The sectioned face of the sample was. observed by a scanning electron microscope to determine the thickness of the electroconductive layer, the backing layer and the polymer layer.

Wet thickness d: The samples were immersed in distilled water at 25° C. for 1 minute. The wet samples were frozen in liquid nitrogen. The sectioned face of the sample was then observed in the same manner.

The swelling ratio ($d/d_0$) was then determined. (4-2) Dimensional stability to development The samples were cut into pieces of 5×cm×25 cm. Two holes having the diameter of 8 mm were opened at the distance of 200 mm in the samples. The samples were conditioned at 25° C. and 55% RH for 24 hours.

The distance between the two holes was measured using a pin gage at the precision of 1/1000 mm. The measured distance is X mm.

The sample was then developed in an automatic developing machine. After the development, the distance between the two holes was measure in the same manner. The measured distance is Y mm.

The dimensional change was calculated according to the following formula $$\text{Dimensional change}=(Y-X)/200\times100\ (\%)$$

The developing conditions are shown below.

Automatic developing machine: FG-800RA (Fuji Photo Film Co., Ltd.)

Developing solution: LD835 (Fuji Photo Film Co., Ltd.)

Fixing solution: GR-F1 (Fuji Photo Film Co., Ltd.)

Temperature: 38° C.

Time: 20 seconds

Drying temperature: 45° C.

(4-3) Dimensional stability to humidity

The dimensional stability to humidity was determined in the same manner as in Example 2.

(4-4) Relative exposure

The relative exposure was determined in the same manner as in Example 1.

The results are set forth in Table 5.

TABLE 5

| No. | Support | Polymer layer | Swelling (1) | Swelling (2) | Stability (3) | Stability (4) | Relative Exposure |
|---|---|---|---|---|---|---|---|
| 3-1 | SPS | P-1 | 1.1 | 1.0 | 0.5 | 1.2 | 85 |
| 3-2 | SPS | P-2 | 1.1 | 1.0 | 0.5 | 1.1 | 86 |
| 3-3 | SPS | P-3 | 1.0 | 1.0 | 0.5 | 1.1 | 85 |
| 3-4 | SPS | Gelatin | 1.8 | 1.9 | 1.4 | 1.3 | 86 |
| 3-5 | PET | P-1 | 1.0 | 1.0 | 0.7 | 1.8 | 100 |
| 3-6 | PET | P-2 | 1.1 | 1.0 | 0.6 | 1.7 | 100 |
| 3-7 | PET | P-3 | 1.0 | 1.0 | 0.7 | 1.8 | 100 |
| 3-8 | PET | Gelatin | 1.8 | 1.9 | 1.7 | 2.0 | 100 |

Remark:

(SPS) Syndiotactic styrenic polymer support

TABLE 5-continued

| No. | Support | Polymer layer | Swelling (1) | Swelling (2) | Stability (3) | Stability (4) | Relative Exposure |
|---|---|---|---|---|---|---|---|

(PET) Polyethylene terephthalate support (P-1) Latex of cyclohexyl acrylate/methacrylic acid copolymer (95/5, average particle size: 0.12 μm)

(P-2) Latex of methyl methacrylate/2-ethylhexyl acrylate/styrene copolymer (61/29/10, average particle size: 0.20 μm)

(P-3) Latex of methyl methacrylate/ethyl acrylate/methacrylic acid/glycidyl methacrylate (60/30/4/6, average particle size: 0.09 μm)

Swelling (1) The swelling ratio of the electroconductive layer and the backing layer Swelling (2) The swelling ratio of the polymer layer Stability (3) The dimensional change to development ($10^{-2}$%)

Stability (4) The dimensional change to humidity ($10^{-3}$%/% RH)

As is shown in the results of Table 5, the samples 3-1 to 3-4 of the present invention show the excellent relative humidity. Further, the samples 3-1 to 3-3 having the hydrophobic backing layer on the hydrophilic backing layer show the excellent dimensional stability.

Example 4

(1) Synthesis of polymer

The syndiotactic styrenic polymers (styrene/p-methyl styrene syndiotactic copolymer) were prepared in the same manner as in Example 1. Further, mixtures of styrenic polymers (mixture of syndiotactic polystyrene and styrene/p-methylstyrene syndiotactic copolymer) were prepared. The styrene contents of the polymers or the mixtures are set forth in Table 6.

The weight average molecular weight of the polymer was in the range of 400,000 to 500,000. The number average molecular weight of the polymer was in the range of 220,000 to 260,000. The content of the racemic pentad (measured by $^{13}$C-NMR) was 70 to 74%.

(2) Formation of support (2-1) Extrusion and formation of raw film

The above-prepared polymers were dried for a whole day and night at 150° C. under reduced pressure. Pellets were formed by a single screw extruder. In the case that a polymer mixture was formed, a double screw extruder having a vent was used in place of the single extruder. The pellets were dried for a whole day and night at 130° C. Tg and Tm of the pellets were measured according to the above-mentioned method (4). The results are set forth in Table 6.

The pellets were placed in an extruding machine having a filter and T-die, and then extruded.

The residence time between the hopper and the T-die was 14 minutes. The extruding temperature (the average temperature measured at the outlet of the extruding machine) was Tm+90° C.

The melt extruded from the T-die was hardened on a cooling roll of the casting drum to form a raw sheet. The time between the outlet of T-die and the cooling roll was 0.3 second. Further, a static charge was applied at the casting stage to keep the flatness.

The thickness of the raw sheet was adjusted by controlling the distance between the T-die and the casting drum.

(2-2) Formation of stretched film

The raw sheet was stretched at Tg+15° C. along the longitudinal direction between rolls. The stretching rate was 3,000% per minute. As a result, the length was extended 3.5 times. The sheet was then stretched at Tg+20° C. along the lateral direction using a tenter. The stretching rate was 3,000% per minute. As a result, the length was extended 4.0 times.

The obtained biaxially stretched film was subjected to a heat setting at 250° C. for 30 seconds while conducting a thermal relaxation of 5%.

(2-3) Evaluation of support

After the heat fixing, the thickness of the film, the ultraviolet transmittance, the volume ratio of the spherulites and the expansion coefficient to humidity were measured. The results are set forth in Table 6.

(3) Photographic material (3-1) Preparation

The support was subjected to the surface treatment in the same manner as in Example 1. Further, the undercoating layer was coated on the support in the same manner as in Example 1.

On a side of the support, the following electroconductive backing layer and the surface backing layer were simultaneously coated.

| | |
|---|---|
| Electroconductive backing layer | |
| $SnO_2$/Sb (weight ratio: 9/1, average particle size: 0.25 μm) | 200 mg/m$^2$ |
| Gelatin ($Ca^{2+}$ content: 3,000 ppm) | 77 mg/m$^2$ |
| Compound (6) used in Example 1 | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Surface backing layer | |
| Gelatin ($Ca^{2+}$ content: 30 ppm) | 3.6 g/m$^2$ |
| Compound (6) used in Example 1 | 3 mg/m$^2$ |
| Polymethyl methacrylate particles (average particle size: 4.7 μm) | 50 mg/m$^2$ |
| Compound (7) used in Example 1 | 40 mg/m$^2$ |
| Compound (8) used in Example 1 | 40 mg/m$^2$ |
| Compound (9) used in Example 1 | 80 mg/m$^2$ |
| Sodium dodecylbenzenesulfonate | 75 mg/m$^2$ |
| Sodium dihexyl-α-sulfosuccinate | 20 mg/m$^2$ |
| Compound (11) used in Example 1 | 5 mg/m$^2$ |
| Sodium sulfate | 50 mg/m$^2$ |
| Sodium acetate | 85 mg/m$^2$ |
| 1,2-Bis(vinylsulfonylacetamide)ethane | 150 mg/m$^2$ |

Further, the emulsion layer, the lower protective layer and the upper protective layer were provided on the reverse side of the support in the same manner as in Example 3. The kinetic friction coefficient was in the range of 0.22±0.03 (25° C., 60% RH, sapphire needle: ϕ=1 mm, weight: 100 g, speed: 60 cm/min).

(3-2) Evaluation

The relative exposure was measured in the same manner as in Example 1 except that SR-D1 developing solution (Fuji Photo Film Co., Ltd.) and SR-F1 fixing solution (Fuji Photo Film Co., Ltd.) were used in an automatic developing machine (FG-660F, Fuji Photo Film Co., Ltd.). The development was conducted at 38° C. for 20 seconds. The results are set forth in Table 6.

(4) Preparation of lithographic plate

The sensitivity to a presensitized lithographic plate was measured in the same manner as in Example 1. The results are set forth in Table 6.

TABLE 6

| No. | (1) | (2) | (3) | (4) | (5) | (6) | (7) | (8) | (9) | (10) |
|---|---|---|---|---|---|---|---|---|---|---|
| 6-1 | CP | 95 | 100 | 97 | 250 | 82 | 0.11 | 1.2 | 85 | 62 |
| 6-2 | CP | 90 | 100 | 95 | 250 | 84 | 0.05 | 1.4 | 82 | 60 |
| 6-3 | CP | 99.5 | 100 | 98 | 255 | 80 | 0.57 | 1.1 | 87 | 64 |
| 6-4 | CP | 99.8 | 100 | 98 | 255 | 74 | 8.51 | 1.1 | 94 | 68 |
| 6-5 | CP | 75 | 100 | 93 | 245 | 85 | 0 | 1.8 | 81 | 58 |
| 6-6 | CP | 65 | 100 | 92 | 240 | 85 | 0 | 2.5 | 81 | 58 |
| 6-7 | CP | 99.5 | 125 | 98 | 255 | 79 | 1.25 | 1.1 | 88 | 72 |
| 6-8 | CP | 99.5 | 150 | 98 | 255 | 78 | 1.45 | 1.0 | 88 | 74 |
| 6-9 | CP | 99.5 | 175 | 98 | 255 | 73 | 1.28 | 1.0 | 95 | 78 |
| 6-10 | PM | 95 | 100 | 98 | 250 | 81 | 0.52 | 1.1 | 86 | 63 |
| 6-11 | PM | 90 | 100 | 96 | 250 | 83 | 0.08 | 1.3 | 83 | 61 |
| 6-12 | PM | 99.5 | 100 | 99 | 255 | 80 | 0.67 | 1.1 | 88 | 64 |
| 6-13 | PM | 99.8 | 100 | 99 | 255 | 73 | 10.02 | 1.1 | 95 | 68 |
| 6-14 | PM | 75 | 100 | 94 | 245 | 83 | 0.07 | 1.7 | 82 | 61 |
| 6-15 | PM | 65 | 100 | 93 | 240 | 83 | 0.08 | 2.3 | 82 | 61 |
| 6-16 | CP | 95 | 175 | 97 | 250 | 80 | 0.35 | 1.2 | 85 | 70 |
| 6-17 | CP | 90 | 175 | 95 | 250 | 82 | 0.15 | 1.3 | 82 | 68 |
| 6-18 | PM | 95 | 175 | 98 | 250 | 81 | 0.27 | 1.2 | 86 | 69 |
| 6-19 | PM | 90 | 175 | 96 | 250 | 83 | 0.03 | 1.1 | 83 | 67 |
| 6-20 | PET | — | 100 | 69 | 240 | 72 | 0.01 | 5.5 | 100 | 72 |
| 6-21 | PET | — | 175 | 69 | 240 | 72 | 0.01 | 4.8 | 100 | 85 |

Remark:

(CP) Styrene/p-methylstyrene syndiotactic copolymer (PM) Mixture of syndiotactic polystyrene and styrene/p-methylstyrene syndiotactic copolymer (PET) Polyethylene terephthalate (2) Styrene content in the copolymer or mixture (wt. %)

(3) Thickness of support (μm)

(4) Tg (°C.)

(5) Tm (°C.)

(6) Ultraviolet transmittance (350 nm, %) (where the thickness of the support is 100 μm)

(7) Volume content of spherulites (%)

(8) Expansion coefficient to humidity ($10^{-6}$/% RH)

(9) Relative exposure (where the exposure of the PET support having the same thickness is 100)

(10) Sensitivity to a presensitized lithographic plate (second)

Comparison Example 1

A plastic support (1) having the thickness of 85 μm was prepared in the same manner as in Example 2 of U.S. Pat. No. 5,188,930. The plastic was a mixture of syndiotactic polystyrene and atactic polystyrene. The amount of the atactic polystyrene was 10 wt. % of the amount of the syndiotactic polystyrene. The support (1) was prepared according to a conventional process.

Another plastic support (2) having the thickness of 85 μm was prepared in the same manner as in Example 3 of U.S. Pat. No. 5,188,930. The plastic was styrene/p-methylstyrene syndiotactic copolymer. The copolymer was made from 950 ml of styrene and 50 ml of p-methylstyrene. The support (2) was also prepared according to a conventional process.

The ultraviolet transmittance was measured with respect to the prepared supports (disclosed in U.S. Pat. No. 5,188,930) in the same manner as in Example 1 of the present specification. As a result, the transmittance of the support (1) was 76 %, and that of the support (2) was 77%.

Further, the expansion coefficient to humidity was measure in the same manner as in Example 1. As a result, the coefficient of the supports (1) and (2) was $5\times10^{-7}$, which is the same value as described in U.S. Pat. No. 5,188,930.

As is described above, the support of U.S. Pat. No. 5,188,930 is superior to the support of the present invention with respect to the dimensional stability. On the other hand, the support of the present invention is superior to the of U.S. Pat. No. 5,188,930 with respect to the ultraviolet transmittance. The difference was caused by the specific conditions in the process of the preparation of the support. Particularly, the support of the present invention was conveyed on a roll having a specific diameter at a specific temperature.

We claim:

1. A silver halide photographic material which has a plastic support comprising a syndiotactic styrenic polymer and at least one silver halide emulsion layer provided thereon, wherein the support shows a transmittance at 350 nm of not less than 70%, said transmittance being measured on the support of 100 μm thick.

2. The photographic material as claimed in claim 1, wherein said transmittance at 350 nm is not less than 72%.

3. The photographic material as claimed in claim 2, wherein said transmittance at 350 nm is not less than 80%.

4. The photographic material as claimed in claim 1, wherein said transmittance at 350 nm is in the range of 75 to 95%.

5. The photographic material as claimed in claim 1, wherein said support has a thickness in the range of 90 to 250 μm.

6. The photographic material as claimed in claim 1, wherein the syndiotactic styrenic polymer is a copolymer of styrene with another vinyl monomer.

7. The photographic material as claimed in claim 5, wherein the styrene monomer other than styrene is an alkylstyrene.

8. The photographic material as claimed in claim 1, wherein the plastic support contains spherulites having a diameter in the range of 0.05 to 5 um in an amount of from 0 to 30% by volume of said support.

9. The photographic material as claimed in claim 8, wherein said spherulites having a diameter of from 0.05 to 5 μm comprise from 0 to 20% by volume of the support.

10. The photographic material as claimed in claim 9, wherein said spherulites having a diameter of from 0.05 to 5 μm comprise from 0 to 10% by volume of the support.

11. A silver halide photographic material, comprising (i) a plastic support, which contains a syndiotactic styrenic polymer, and (ii) a silver halide emulsion layer on said support, wherein said support exhibits transmittance at 350 nm of at least 76%, based on a 100 μm thick support, and contains spherulites having a diameter of 0.05 to 5 μm in an amount of 0 to 20% by volume of said support.

* * * * *